US011135121B2

(12) United States Patent
Brodie

(10) Patent No.: US 11,135,121 B2
(45) Date of Patent: Oct. 5, 2021

(54) ASSISTIVE MOBILITY DEVICES AND SYSTEMS AND METHODS FOR USING SAME

(71) Applicant: Climb Easy Walker LLC, Baltimore, MD (US)

(72) Inventor: Jeffrey T. Brodie, Baltimore, MD (US)

(73) Assignee: Climb Easy Walker LLC, Baltimore, MD (US)

( * ) Notice: Subject to any disclaimer, the term of this patent is extended or adjusted under 35 U.S.C. 154(b) by 0 days.

(21) Appl. No.: 16/269,086

(22) Filed: Feb. 6, 2019

(65) Prior Publication Data

US 2020/0246210 A1 Aug. 6, 2020

(51) Int. Cl.
*A61H 3/00* (2006.01)

(52) U.S. Cl.
CPC ..... *A61H 3/00* (2013.01); *A61H 2003/001* (2013.01); *A61H 2201/0192* (2013.01)

(58) Field of Classification Search
CPC ..... A61H 2003/001
See application file for complete search history.

(56) References Cited

U.S. PATENT DOCUMENTS 3,387,617 A * 6/1968 Reiber ..... A61H 3/00 135/67
3,455,313 A * 7/1969 King ..... A61H 3/00 135/67
3,800,815 A * 4/1974 Birk ..... A61H 3/00 135/67
4,777,973 A * 10/1988 Nakajima ..... A61H 3/00 135/67
5,349,977 A * 9/1994 Wood ..... A61H 3/00 135/67
5,649,558 A * 7/1997 Richard ..... A61H 3/00 135/67

(Continued)

OTHER PUBLICATIONS

Fkdewalker, Climbing Stairs Aluminum Folding Lightweight Walking Frame, Walking Mobility Aid, Walker, 6 pgs., https://www.amazon.com/dp/B07HXQXLQN/ref=dp_prsubs_1.

(Continued)

*Primary Examiner* — David R Dunn
*Assistant Examiner* — Danielle Jackson
(74) *Attorney, Agent, or Firm* — Bekiares Eliezer LLP

(57) ABSTRACT

Disclosed herein are self-adjusting devices and systems for assistive ambulation and traversing of stairs. In one aspect, a disclosed assistive device encompasses a frame assembly including a first side frame connected with a second side frame, each side frame with first and second legs each having first and second opposed ends, and a gripping member connecting first ends of the first and second legs, the second ends of first and second legs having an extendable portion configured to allow selective adjustment of a leg length; and a leg adjustment system contained within a portion of each side frame configured to correspondingly lengthen one leg at a leg length adjustment ratio in response to shortening of another leg. In further aspects, the legs can releasably attach to a stabilizing component for stabilizing the device. Also disclosed herein are kits and methods for using the disclosed devices and systems.

19 Claims, 16 Drawing Sheets

(56) References Cited

U.S. PATENT DOCUMENTS

| | | | | |
|---|---|---|---|---|
| 6,145,524 | A * | 11/2000 | Li | A61H 3/00 135/67 |
| 6,453,921 | B1 * | 9/2002 | Rost | A61H 3/00 135/67 |
| 7,363,931 | B2 * | 4/2008 | Weaver | A61G 7/1038 135/66 |
| 8,667,976 | B2 * | 3/2014 | Huang | A61H 3/00 135/67 |
| 8,820,338 | B1 * | 9/2014 | Catricala | A61H 3/00 135/67 |
| 9,119,757 | B2 | 9/2015 | Triolo et al. | |
| 9,545,354 | B1 * | 1/2017 | Klausmeyer | A61H 3/00 |
| 9,839,570 | B2 * | 12/2017 | O'Sullivan | A61H 3/04 |
| 10,500,121 | B2 * | 12/2019 | Triolo | A61H 3/00 |
| 2012/0298160 | A1 * | 11/2012 | Hamilton | A61H 3/00 135/66 |
| 2014/0109944 | A1 | 4/2014 | Triolo et al. | |

OTHER PUBLICATIONS

Nottingham Spirk, The Business Innovation Firm, "Cast Study: Self-Leveling Walker, A stair-capable walker recognized as a medical device innovation that improves lives,", 6 pgs., https://nottinghamspirk.com/project/self-leveling-walker/.

U.S. Department of Veterans Affairs, Advanced Platform Technology Center, Self-Leveling Walker, Jan. 15, 2020, 3 pgs., https://www.aptcenter.research.va.gov/Innovation/Self-Leveling-Walker/Self_Leveling_Walker.asp.

* cited by examiner

ASSISTIVE MOBILITY DEVICES AND SYSTEMS AND METHODS FOR USING SAME

FIELD OF INVENTION

The present invention relates to assistive devices, systems, and methods for ambulation and traversing stairs, and specifically, appliances for aiding patients or disabled persons to walk about and personal conveyances specially adapted for patients or disabled persons.

BACKGROUND OF THE INVENTION

Mobility for seniors and patients suffering from lower extremity injuries is desirable as it allows for independent lifestyles for seniors and patients. Independent living helps the public welfare as it lessens the economic burden on the healthcare system required to provide the necessary care for individuals that require mobility assistance. According to U. S. Census Bureau data for the time frame of 2009 to 2011, 19.5 million people per year in the U.S. have "ambulatory difficulty". To this end, Frost and Sullivan's U. S. Mobility Aid Markets report notes that more than 500,000 walkers are sold in the US each year, with estimates of 1 million by 2040. The U. S. Department of Health and Human Services reports approximately 47,000 falls and/or injuries per year related to the use of walkers and canes. Furthermore, many patients cannot ascend stairs safely due to a multitude of factors. These factors can include, but are not limited to, generalized weakness due to age or neurological deficits, as well as non-weight bearing status due to lower extremity injury or surgery. These patients are often restricted in their abilities to get to their bedrooms and bathrooms, particularly when living in two story homes. Consequently, the foregoing can require these patients to rent home hospital beds, or perhaps move out of their homes.

Due to the lack of suitable assistance many patients recovering from lower extremity surgery often go up and down stairs sitting on their buttocks and propel their bodies with both arms and their good leg. They must then attempt to get up off the ground once they arrive at their destination. For elderly who wish to remain in their homes, they typically hold onto a railing with both hands and propel themselves up or down the stairs positioned sideways which can lead to falls and injury. For those who are required to completely offload an injured extremity, younger strong patients can use a crutch under one arm and the railing in the other hand. Many patients will sit down on the stairs and have to propel themselves up or down the stairs on their buttocks, then stand back up at either end of the stairs.

Current options for ascending and descending stairs include standard railings which are not balanced, and awkward. An electronic chair can be installed along the wall that can propel an individual up or down. However, such a device requires significant mechanical attachment to the wall and can cost between $4,000 and $10,000. Some stair capable walkers have been developed, which are either self-propelled or mechanized; or provide adjustable front legs; however, none of these existing devices solve the problem of providing adequate stability on stairways and thus lack structural support.

Accordingly, there remains a need for improved walkers and mobility devices that allow an individual to ambulate safely on flat surfaces as well as during the stair traversing process. Such a device would preferably be self-adjusting, capable of being releasably secured to the stairs, and provide sufficient stability, balance and confidence while ambulating and traversing stairs. This need and other needs are satisfied by the various aspects of the present disclosure.

SUMMARY OF THE INVENTION

In accordance with the purposes of the invention, as embodied and broadly described herein, the invention, in one aspect, relates to devices, systems, and methods for assistive ambulation and traversing of stairs. This brief overview is provided to introduce a selection of concepts in a simplified form that are further described below in the Detailed Description. This brief overview is not intended to identify key features or essential features of the claimed subject matter. Nor is this brief overview intended to be used to limit the claimed subject matter's scope.

In further aspects, invention can include leg adjustment mechanism or system configured to self-adjust the legs for ambulating flat surface or traversing stairs. In still further aspects, the invention can releasably attach to stair treads or other to provide a secure fixation to help the user propel themselves up the stairs, or ease themselves down the stairs safely. Once at the top or bottom of the stairs, the legs can self-adjust to allow for ambulation on flat surfaces. Accordingly, the present invention can allow a user to ascend and descend almost any set of stairs.

In an exemplary aspect, the invention relates to an assistive mobility device comprising a frame assembly comprising: a first side frame connected with a second side frame, each side frame comprising: first and second legs each having first and second opposed ends, and a gripping member connecting first ends of the first and second legs, the second ends of first and second legs having an extendable portion configured to allow selective adjustment of a leg length; and a leg adjustment system contained within a portion of each side frame configured to correspondingly lengthen one leg at a leg length adjustment ratio in response to shortening of another leg.

In another exemplary aspect, the invention relates to a system for assistive ambulation and traversing of stairs, the system comprising a self-adjusting assistive mobility device configured to releasably attach to a stabilizing component. In further aspects, the stabilizing component is configured to releasably attach with a portion of the assistive mobility device attachment component for stabilizing the assistive mobility device effective to allow a user to propel themselves upwards by pulling on the assistive mobility device when ascending up an incline.

In another exemplary aspect, the invention relates to a method for assisting a user in ambulating; the method comprising: providing a disclosed assistive mobility device; and using the assistive mobility device in connection with ambulation or traversing of stairs.

In further aspects, the invention also relates to additional methods for using the disclosed devices and systems, and kits comprising the disclosed devices.

Additional aspects of the invention will be set forth in part in the description which follows, and in part will be obvious from the description, or can be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate several aspects of the invention and together with the description, serve to explain the principles of the invention. The drawings may contain representations of various trademarks and copyrights owned by the Applicant. In addition, the drawings may contain other marks owned by third parties and are being used for illustrative purposes only. All rights to various trademarks and copyrights represented herein, except those belonging to their respective owners, are vested in and the property of the Applicant. The Applicant retains and reserves all rights in its trademarks and copyrights included herein, and grants permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAILED DESCRIPTION OF THE INVENTION

Figure 1:
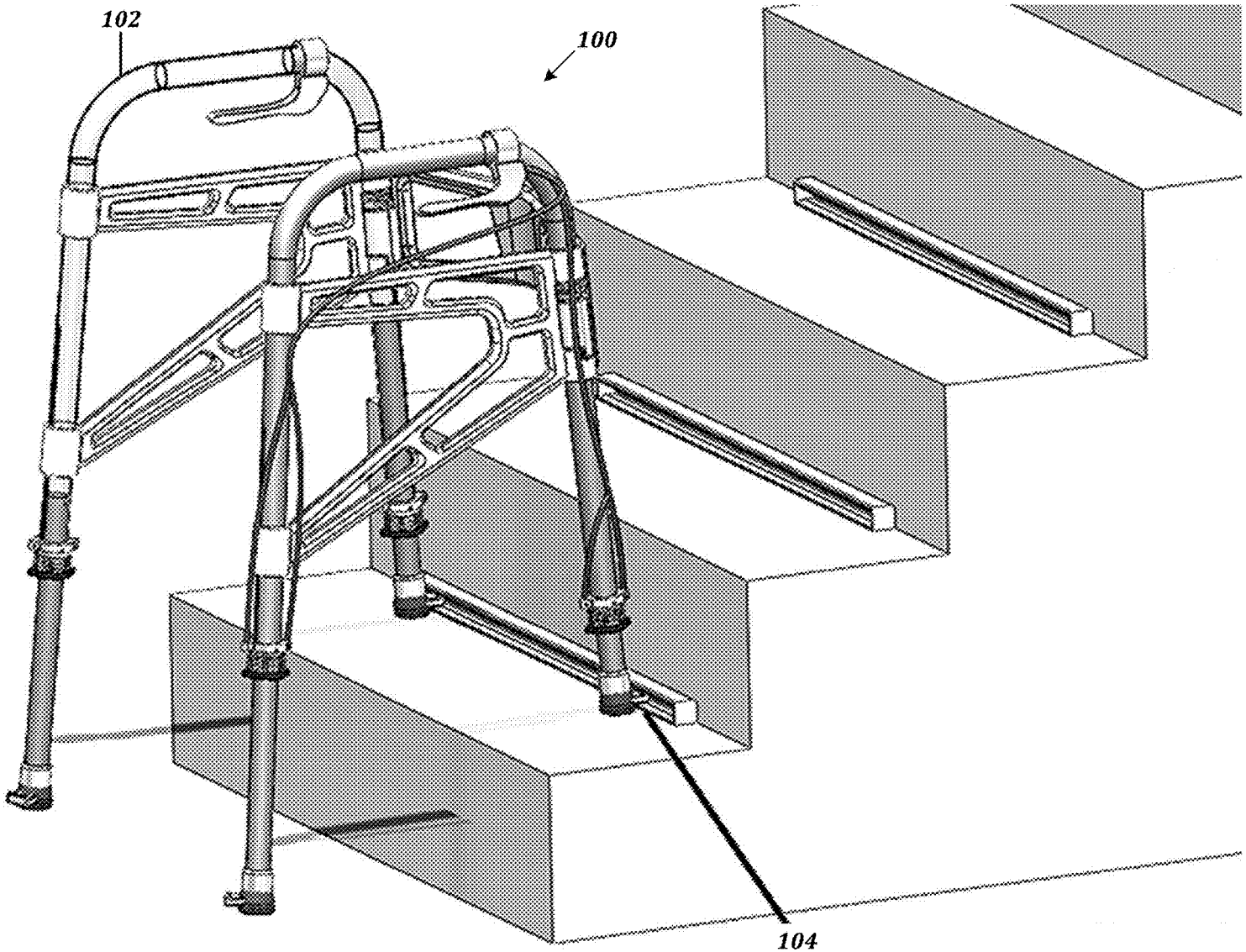
FIG. 1 shows a depiction of an assistive mobility system in an operating environment in accordance with an exemplary embodiment of the present disclosure.

The present invention can be understood more readily by reference to the following detailed description of the invention and the Examples included therein.

Before the present articles, systems, devices, and/or methods are disclosed and described, it is to be understood that they are not limited to specific manufacturing methods unless otherwise specified, or to particular materials unless otherwise specified, as such can, of course, vary. It is also to be understood that the terminology used herein is for the purpose of describing particular aspects only and is not intended to be limiting. Although any methods and materials similar or equivalent to those described herein can be used in the practice or testing of the present invention, example methods and materials are now described.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

All publications mentioned herein are incorporated herein by reference to disclose and describe the methods and/or materials in connection with which the publications are cited.

A. Definitions

It is also to be understood that the terminology used herein is for the purpose of describing particular aspects only and is not intended to be limiting. As used in the specification and in the claims, the term "comprising" can include the aspects "consisting of" and "consisting essentially of" Unless defined otherwise, all technical and scientific terms used herein have the same meaning as commonly understood by one of ordinary skill in the art to which this invention belongs. In this specification and in the claims, which follow, reference will be made to a number of terms which shall be defined herein.

As used in the specification and the appended claims, the singular forms "a," "an" and "the" include plural referents unless the context clearly dictates otherwise. Thus, for example, reference to "a leg" includes two or more legs.

Ranges can be expressed herein as from one particular value, and/or to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the value designated some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

Disclosed are the materials, components, parts, and/or elements to be used to manufacture the disclosed devices and systems of the invention as well as the materials themselves to be used within the methods disclosed herein. These and other materials are disclosed herein, and it is understood that when combinations, subsets, interactions, groups, etc. of these materials are disclosed that while specific reference of each various individual and collective combinations and permutation of these materials cannot be explicitly disclosed, each is specifically contemplated and described herein. For example, if a particular material is disclosed and discussed and a number of modifications that can be made to the materials are discussed, specifically contemplated is each and every combination and permutation of the material and the modifications that are possible unless specifically indicated to the contrary. Thus, if a class of materials A, B, and C are disclosed as well as a class of materials D, E, and F and an example of a combination material, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the articles and devices of the invention. Thus, if there are a variety of additional steps that can be performed it is understood that each of these additional steps can be performed with any specific aspect or combination of aspects of the methods of the invention.

It is understood that the devices and systems disclosed herein have certain functions. Disclosed herein are certain structural requirements for performing the disclosed functions, and it is understood that there are a variety of structures that can perform the same function that are related to the disclosed structures, and that these structures will typically achieve the same result.

B. Assistive Mobility Devices and Systems

As briefly described above, the present disclosure provides, in various aspects, devices and systems for assistive ambulation and traversing of stairs. In further aspects, the disclosed devices and systems may be useful for providing walking assistance to disabled persons and patients requiring temporary assistance. In still further aspects, the device can be useful for patients with lower extremity injuries. In even further aspects, the device can be useful for patients recovering from lower extremity treatments or surgeries. In some aspects, the disclosed devices and systems may be used by individuals who are not permanently disabled, but are experiencing pain in their feet or lower extremities.

In one aspect, the present disclosure provides an assistive mobility device comprising: a frame assembly comprising: a first side frame connected with a second side frame, each side frame comprising: first and second legs each having first and second opposed ends, and a gripping member connecting first ends of the first and second legs, the second ends of first and second legs having an extendable portion configured to allow selective adjustment of a leg length; a leg adjustment system contained within a portion of each side frame configured to correspondingly lengthen one leg at a leg length adjustment ratio in response to shortening of another leg; at least one braking or locking mechanism in mechanical communication with the extendable portion of each leg configured to releasably secure the extendable portion of the leg in a locked state at a fixed leg length; at least one actuator in operable communication with the at least one braking mechanism configured to selectively release the extendable portion of each leg in an unlocked state to allow adjustment of the leg length; at least one cross support having first and second ends connecting the first side frame with the second side frame. In further aspects, the frame assembly may be configured to releasably attach to a fixed object for stabilizing the frame assembly effective to allow a user to propel themselves upwards by pulling on the frame assembly when ascending up an incline.

In another aspect, the present disclosure provides a system for assistive ambulation and traversing of stairs, the system comprising an assistive mobility device configured to releasably attach to a stabilizing component. In further aspects, the assistive mobility device comprises a frame assembly comprising: a first side frame connected with a second side frame, each side frame comprising: first and second legs each having first and second opposed ends, and a gripping member connecting first ends of the first and second legs, the second ends of first and second legs having an extendable portion configured to allow selective adjustment of a leg length, the extendable portion having an attachment component configured to releasably attach to a stabilizing component; a leg adjustment system contained within a portion of each side frame configured to correspondingly lengthen one leg at a leg length adjustment ratio in response to shortening of another leg; at least one braking mechanism in mechanical communication with the extendable portion of each leg configured to releasably secure the extendable portion of the leg at a fixed position and leg length; at least one actuator in operable communication with the at least one braking mechanism for selectively releasing the extendable portion of each leg to allow adjustment of the leg length; at least one cross support having first and second ends connecting the first side frame with the second side frame; and a stabilizing component configured to releasably attach with the attachment component for stabilizing the assistive mobility device effective to allow a user to propel themselves upwards by pulling on the frame assembly when ascending up an incline.

According to various aspects of the invention, the devices and systems of the present disclosure can comprise multiple configurations. FIGS. 1-16 illustrate non-limiting examples of embodiments of operating environments, mechanisms, and components for the disclosed devices and systems. Although the operating environments, mechanisms, and components are disclosed with specific functionality, it should be understood that functionality may be shared between mechanisms and/or components, with some functions split between mechanisms and/or components, while other functions duplicated by the mechanisms and/or components. Furthermore, the name of the mechanisms and/or components should not be construed as limiting upon the functionality of the mechanisms and/or components. Moreover, each stage in the claim language can be considered independently without the context of the other stages. Each stage may contain language defined in other portions of this specifications. Each stage disclosed for one mechanism and/or component may be mixed with the operational stages of another mechanism and/or component. Each stage can be claimed on its own and/or interchangeably with other stages of other mechanisms and/or components.

FIG. 1 shows an exemplary embodiment of a system 100 for assistive ambulation in accordance with the present invention, the system 100 comprising an assistive mobility device 102 and stabilizing component 104. As shown, the stabilizing component 104 is in the form of a slotted rail affixed to a bottom portion of the stair riser, and the assistive mobility device 102 is secured and stabilized to the stabilizing component 104 for use in connection with traversing up the step.

Consistent with various embodiments of the present disclosure, the invention is described as including a frame assembly with connected side frames having one or more adjustable legs, a leg adjustment mechanism or system for adjusting the lengths of the legs, and braking mechanism for securing the extendable portion of the leg at a fixed position. If the invention is used in a pair of side frames, generally, each of the side frames will have the same number of legs, leg adjustment systems, and braking mechanisms, but not necessarily so. In further aspects, some embodiments of the invention, however, may provide only one of the side frames with a leg adjustment mechanism or system, while the other of the pair does not contain any leg adjustment mechanism or system, but may still be in operable communication with the leg adjustment mechanism or system of the other side frame.

In various aspects, the frame assembly includes a first side frame connected with a second side frame. Each pair of side frames may be arranged in left and right pairs. For example, and without limitation, the first side frame may comprise a left side frame and the second side frame may comprise a right-side frame. In further aspects, the side frame can comprise first and second legs each having first and second opposed ends, and second ends of the legs having an extendable portion configured to allow selective adjustment of a leg length.

In further aspects, the side frame comprises a gripping member between and connecting the first leg with the second leg. In still further aspects, the gripping member may comprise a tubular member having a substantially U shape, such as a hollow member having two curve sections and gripping section therebetween that is substantially parallel to the ground. In even further aspects, the gripping member may connect first ends of the first and second legs. In yet further aspects, the gripping member may comprise opposed ends connected to upper first ends of each pair of front and rear (i.e., first and second) legs. In still further aspects, the gripping member may extend between upper first ends of each pair of front and rear (i.e., first and second) legs. In even further aspects, the gripping member comprises a gripping portion configured to be grasped by a user.

In further aspects, the frame assembly comprises at least one cross support having first and second ends connecting the first side frame with the second side frame. In yet further aspects, the frame assembly cross support may comprise a substantially horizontal crossmember extending between the first and second side frames. In even further aspects, the frame assembly cross support may comprise a substantially horizontal crossmember connected to and extending between the front leg of the first side frame and the front leg of the second side frame. In still further aspects, each side frame may also comprise at least one side cross support connecting the first leg with the second leg. In even further aspects, the side cross support can comprise a substantially horizontal crossmember extending between the first and second side legs and/or a substantially diagonal crossmember extending between the first and second side legs. In yet further aspects, the side cross support may comprise a substantially horizontal and/or a substantially diagonal crossmember connected to and extending between the front leg of the side frame and the rear leg of the side frame. The cross support may comprise a cross bar, member, beam, brace, and/or other means for providing structural support between the side frames and/or legs. In further aspects, the cross support may comprise a formed plastic housing or casing. In some aspects, the frame assembly can have an operation configuration such that each pair of first and second legs define a common vertical plane and are configured to intersect a vertical plane defined by the ends of the frame assembly cross support at a substantially perpendicular angle. In other aspects, the middle portion of frame assembly cross support can be bowed outward to allow a user to for their bodies to come forward and not contact the front portion of the frame assembly.

In various aspects, each adjustable leg may comprise an upper (e.g., main) leg member and a lower extendable leg member. To this end, the extendable portion of the leg comprise an extendable member having a first diameter adjustably connected to a corresponding portion of the leg comprising a leg member having a second diameter larger than the first diameter. In further aspects, the lower extendable member may be slidably movable into the upper leg member. In still further aspects, the legs may comprise telescoping tubular members, for example, telescoping members that may be arranged to radially extend (i.e., lengthen) and retract (i.e., shorten). In further aspects, each pair of first and second legs may comprise substantially vertical front and rear side legs. To this end, the first and second legs of the first side frame can comprise a left front leg and a left rear leg, respectively, and the first and second legs of the second side frame can comprise a right front leg and a right rear leg, respectively. Frame and leg members used to construct the frame assembly may be in the shape of a three-dimensional polygon, such as a tubular or cylinder shape, and the frame walls may define an interior space or interior sections for containing various operating elements of the invention as described herein. Any other shape (as used herein, the term shape is used in the broad sense of three-dimensional works) may be employed, so long as the shape is structured so as to be able support the methods of using the invention as more fully disclosed below. In some aspects, the frame can comprise a plurality of connected tubular members.

Figure 2:
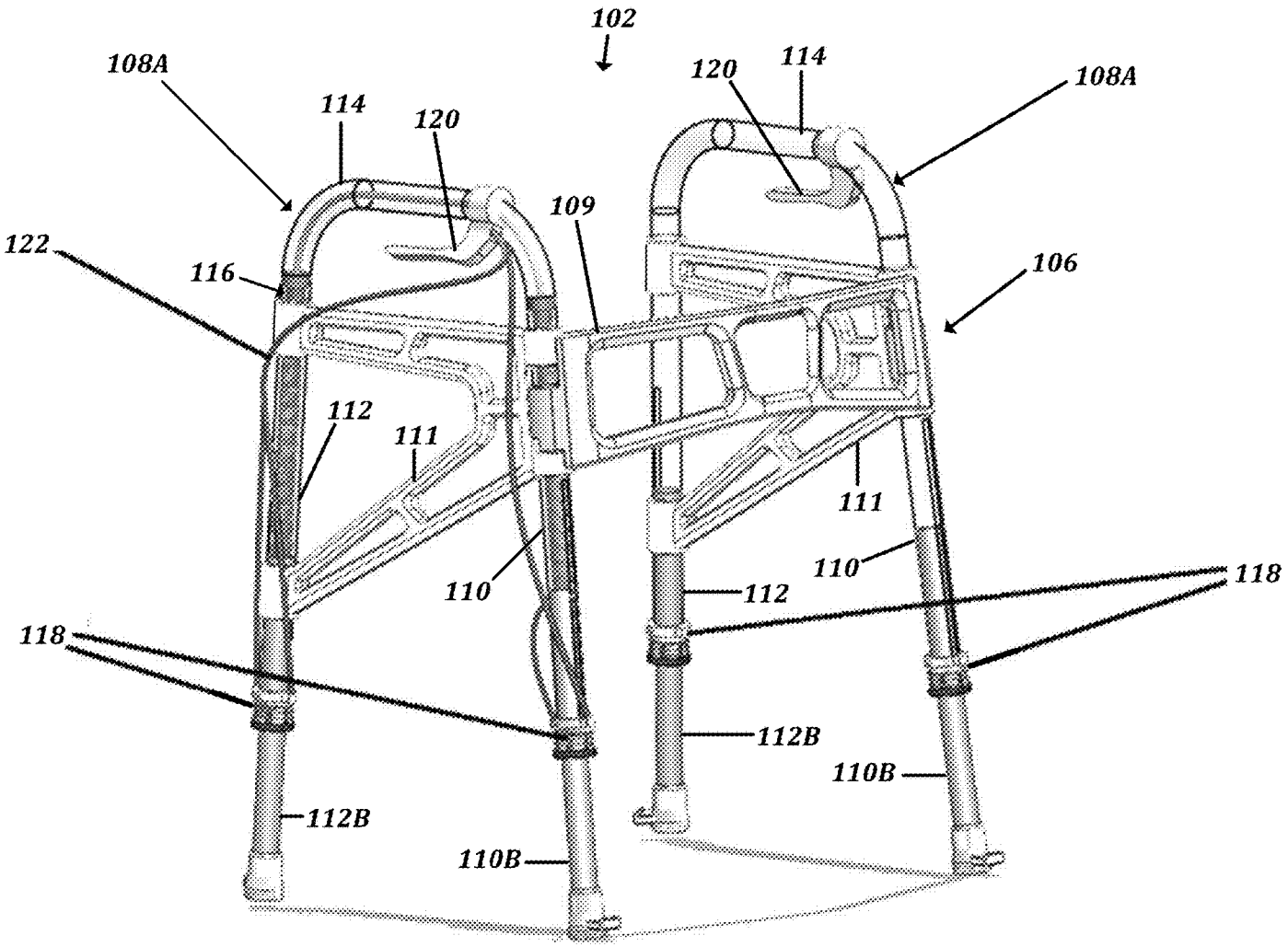
FIG. 2 shows a depiction of an assistive mobility device in accordance with an exemplary embodiment of the present disclosure.

FIG. 2 shows exemplary embodiment of assistive mobility device and configuration in accordance with the present invention. As shown, the assistive mobility device 102 comprises frame assembly 106 including a right side frame 108A connected with a left side frame 108B via a front cross support 109, specifically connected at the first and second ends of the front cross support 109. Each side frame comprises a front leg 110, a rear leg 112, a side cross support 111 connected between the front and rear legs, and a gripping member 114 connecting the first ends of the first and second legs. The second ends of both first and second legs have an extendable portion 110B, 112B which are configured extend and retract to allow selective adjustment of the leg length.

As will be further described herein, the frame assembly employs a leg adjustment system 116 contained within a portion of each side frame which is configured to self-adjust the legs, for example and without limitation, by lengthening one leg at a corresponding leg length adjustment ratio in response to shortening of the other leg. Each leg includes a braking mechanism 118 in mechanical communication with the extendable portion of the leg which is configured to releasably secure the extendable portion of the leg in a locked state and fixed leg length, for example, when the device is being used to ambulate or traverse stairs. When the braking mechanism is in the locked position, the user or the leg adjustment system is prevented from moving the extendable portion to adjust the leg length.

Each side frame also comprises actuator 120, shown in the form of a brake handle, in operable communication with the braking mechanisms 118 using linking cables 122. Upon squeezing or activating, the actuator 120 is configured actuate the associated braking mechanisms 118 from a locked position to an unlocked position, which then releases the extendable portions to allow movement of the extendable portions and adjustment of the leg length.

According to various further aspects of the invention, the frame assembly can be collapsible or foldable. In further aspects, the frame assembly is configured to collapse from an expanded state to a folded state, and expand from a folded state to an expanded state. In still further aspects, in the expanded state, the first and second side frames are connected to the frame assembly crossmember in a manner that defines a space for a user to occupy. In yet further aspects, the first and second side frames may be pivotably or hingedly connected to the front cross support of the frame assembly such that the side frames are collapsible against the front cross support.

In further aspects, the frame assembly may comprise a locking mechanism configured to releasably secure the frame assembly in the expanded state. To this end, the side frame may pivotably or rotatably connected to an end of the front cross support and said side frame may also be connected to an end of the side cross support of the frame assembly, and the end of the front cross support and the end of the side cross support are configured to cooperate to releasably secure the side frame in a locked state. In even further aspects, one or more ends of the front cross support and/or one or more ends of the side cross support may comprise a locking mechanism configured to releasably secure the side frame in a locked state. In yet further aspects, one or more ends of the front cross support and one or more ends of the side cross support may comprise a complementary locking arrangement configured to releasably secure the side frame in a locked state. In some aspects, one or more ends of the front cross support and one or more ends of the side cross support may comprise a tongue and groove arrangement configured to releasably secure the side frame in a locked state.

Figure 3:
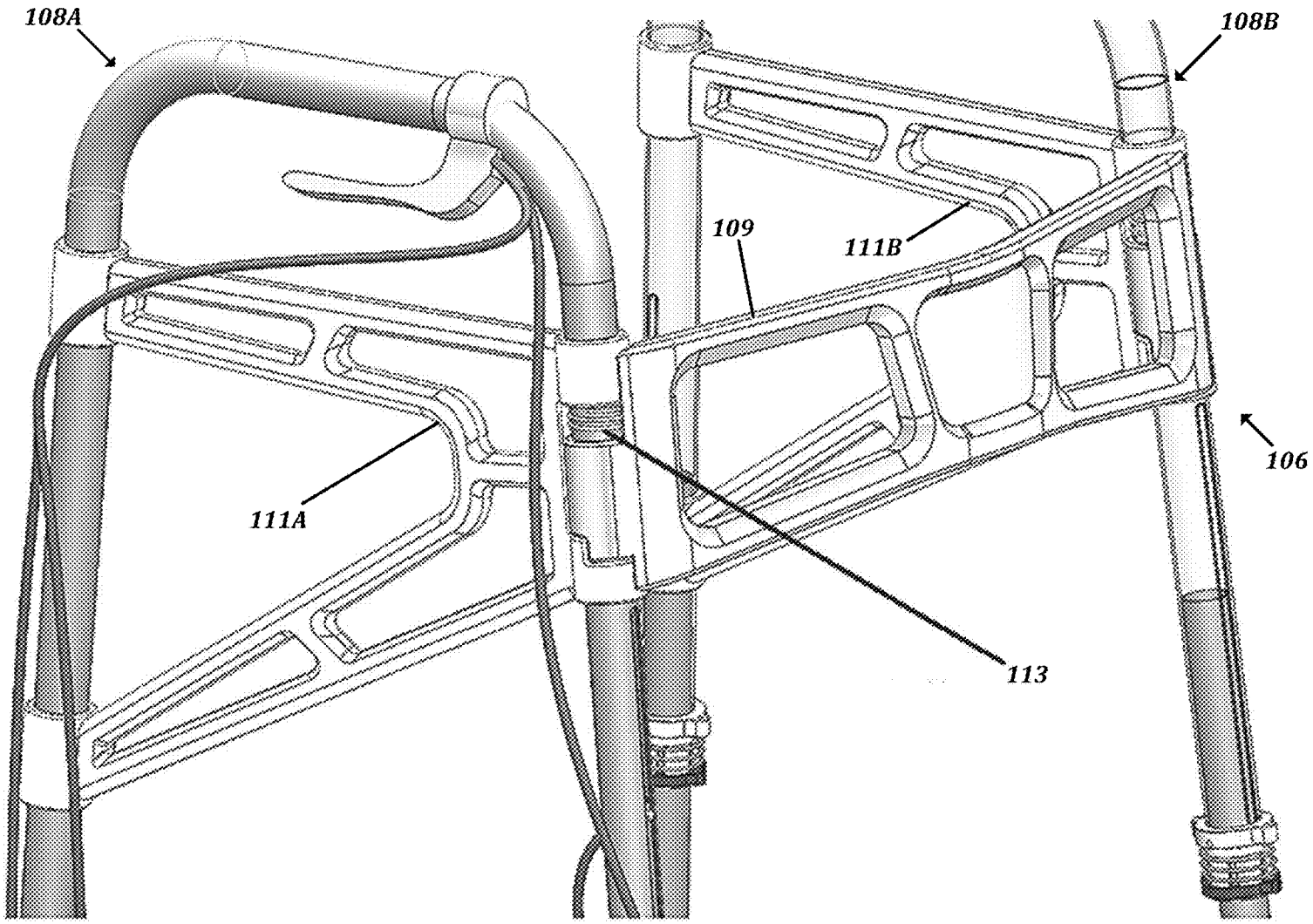
FIG. 3 shows a depiction of collapsible features employed in assistive mobility device in accordance with an exemplary embodiment of the present disclosure.

FIG. 3 shows frame assembly 106 and collapsible features in a fully expanded, locked state. Frame assembly 106 includes right side frame 108A rotatably connected to the first end of front cross support 109 and fixedly connected to the first end of right side cross support 111A. Left side frame 108B is rotatably connected to the second end of front cross support 109 and fixedly connected to the first end of the second side cross support 111B. As shown, both ends of the front cross support 109 and first ends of both side cross supports comprise tongue and groove cooperative arrangement. First end of front cross support 109 and the first end of the first side cross support 111A are shown coupled using the in a locked, expanded state. A spring or tension element 113 or other means for producing a force is used to releasably maintain the side frame in the locked state.

In various aspects, the frame assembly, or a portion thereof, may be configured to releasably attach to a fixed object for stabilizing and securing the frame assembly, for example, to allow a user to pull themselves upwards using the frame assembly when ascending up an incline, such as stairs. In some aspects, the legs may be the portion of the configured to attach to a fixed object for stabilizing. In this aspect, the leg may comprise a connecting element or attachment component or other connecting means for releasably attaching to a fixed object for stabilizing the device effective to allow a user to propel themselves upwards by pulling on the frame assembly when ascending up an incline.

In still further aspects, the extendable portion of the leg may comprise a foot that can have the connecting means or attachment component configured to releasably attach to a fixed object. In yet further aspects, the fixed object and the attachment component may cooperate to releasably secure the frame assembly to the fixed object for stabilizing the device effective to allow a user to propel themselves upwards by pulling on the frame assembly when ascending up an incline.

Figure 4:
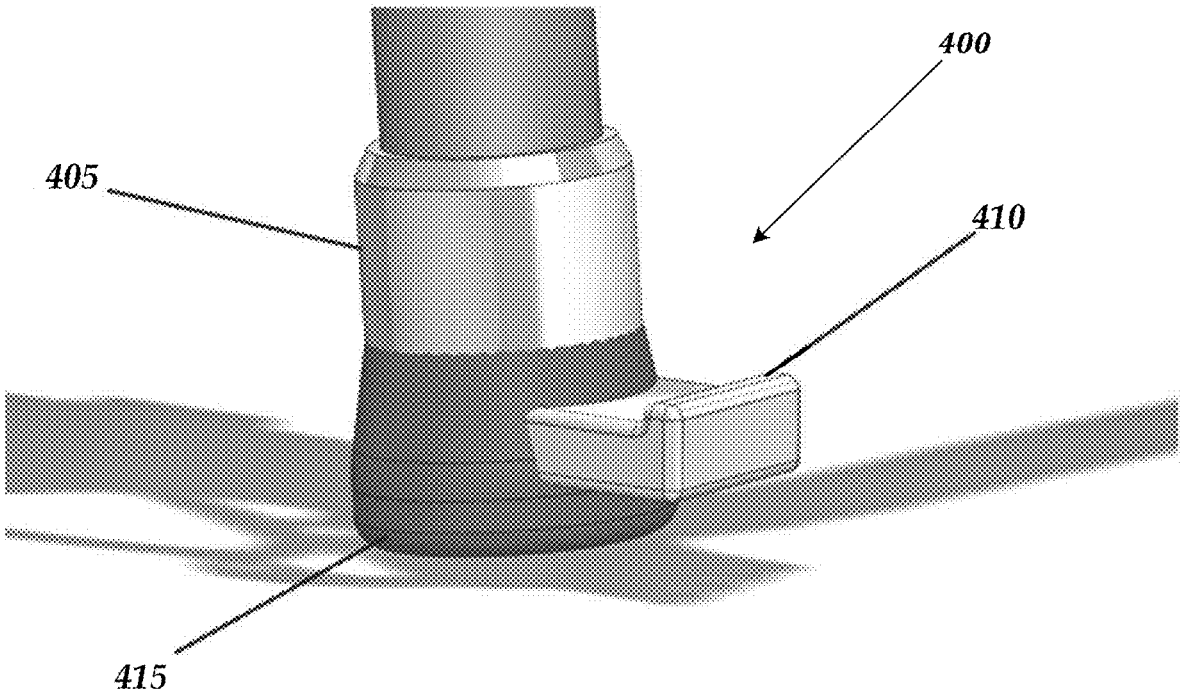
FIG. 4 shows a depiction of attachable foot component for use in an assistive mobility device in accordance with an exemplary embodiment of the present disclosure.

FIG. 4 shows an exemplary foot 400 including foot mounting 405, foot attachment component 410, and foot gripping area 415. The rectangular foot attachment component 410 are configured to allow the device to matingly interlock into a guide or stabilizing component. As shown in FIG. 1, the stabilizing component 104 may comprise rails or other similar structure that can be configured to be affixed to a stair riser and/or tread. The stabilizing component is configured cooperate with the foot 400 to provide support and stabilization of the frame assembly at each step of the platform when ascending and descending stairs. The stabilizing component further configured to prevent the mobility device 102 from slipping or coming off the stairs during use.

In further aspects, the foot and/or foot gripping area can be comprised of any suitable material, such as, for example, plastic, rubber, high density cushioning foam, foam and fabric, or other material adapted for ground impact. In some aspects, the foot and/or foot gripping area may also comprise a tread pattern to provide traction. In other aspects, the foot may contain a flat bottom.

As described above, the fixed object may comprise a stabilizing component or other means for securely stabilizing the frame assembly and/or legs in fixed position. In some aspects, the fixed object may comprise a groove and the attachment component may comprise a tongue, and the tongue and groove may cooperate to releasably secure the frame assembly to the fixed object. In other aspects, the fixed object and/or stabilizing component may comprise a rail or channel or other structural means for releasably coupling with the attachment component. In still other aspects, the stabilizing component and foot attachment (with or without the foot mounting) may comprise a stabilizing system, and may be separately used for retrofitting existing walkers and assistive mobility device to impart the disclosed advantages thereof.

Figure 5:
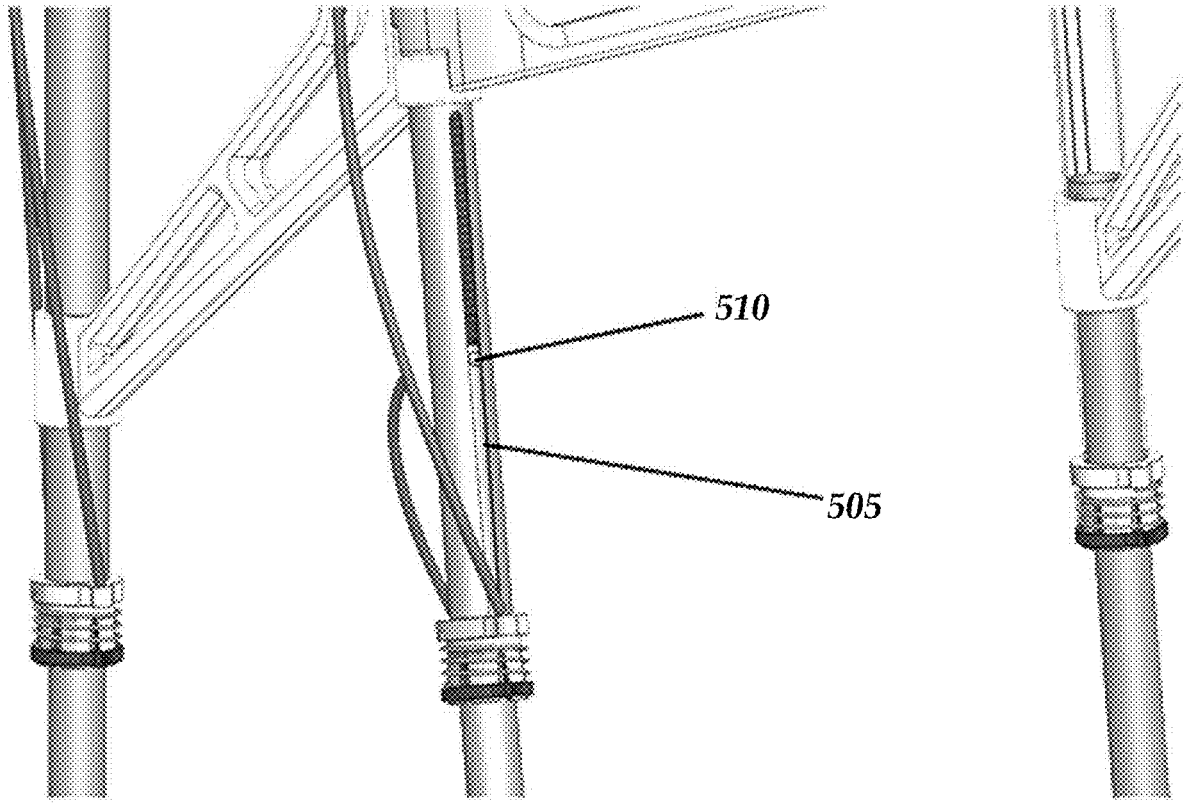
FIG. 5 shows a depiction of a leg guiding mechanism for use in an assistive mobility device in accordance with an exemplary embodiment of the present disclosure.

In further aspects, the leg may comprise a guiding mechanism configured to direct movement of the extendable portion along a fixed travel path. In still further aspects, the guiding mechanism may be configured to prevent rotational movement of the extendable portion. In yet further aspects, the guiding mechanism may comprise a slot and pin arrangement, or like mechanism effective to control the travel path and/or rotation of the extendable portion of the leg. In other aspects, the slot may be disposed along a section of the upper leg member or portion and the pin may be disposed on at an end of the extendable portion. The slot may be configured to receive the pin and direct movement of the pin along the slot in a fixed travel path. FIG. 5 shows an exemplary guiding mechanism including a slot 505 disposed along the upper leg portion and a pin 510 disposed on the outer surface at the first end of the extendable portion. The slot receives the pin within the slot and directs movement of the extendable portion of the leg in a fixed travel path.

In various further aspects, the invention includes at least one braking or locking mechanism or other means for releasably securing or locking the extendable portion of the leg at fixed position, each position corresponding to a leg length. In further aspects, the frame assembly may comprise a plurality of braking mechanisms, each leg comprising its own the braking mechanism. In still further aspects, the braking mechanism may be in mechanical communication with one or more portions of a given leg and configured to selectively secure or lock the extendable portion of that leg at a fixed leg length.

In further aspects, the braking mechanism may comprise a locked position and an unlocked position. When the braking mechanism is in the locked position, the extendable portion of the leg may be in a locked state at a fixed leg length and unable to move or be adjusted. When the braking mechanism is in the unlocked position, the extendable portion of the leg may be in an unlocked state whereby the extendable portion is able to extend and/or retract and thus the leg length can be adjusted. To this end, releasing the braking mechanism, or moving into unlocked position, is configured to allow the user to adjust the leg length of each leg by applying pressure to a portion of the side frame to shorten a corresponding leg. Shortening a first leg thereby causes the leg adjustment system to self-adjust, or cooperatively lengthen the other leg of same side frame, as is further described herein. In further aspects, the braking mechanism may be disposed on an outer surface of the leg. In still further aspects, the braking mechanism may be attached to an outer surface at the second end of the upper leg portion or member. In still further aspects, the braking mechanism may comprise first and second portions, the first portion being attached to an outer surface of the upper leg portion and the second portion in mechanical communication for selectively securing or locking the extendable lower portion of the leg.

Figure 6:
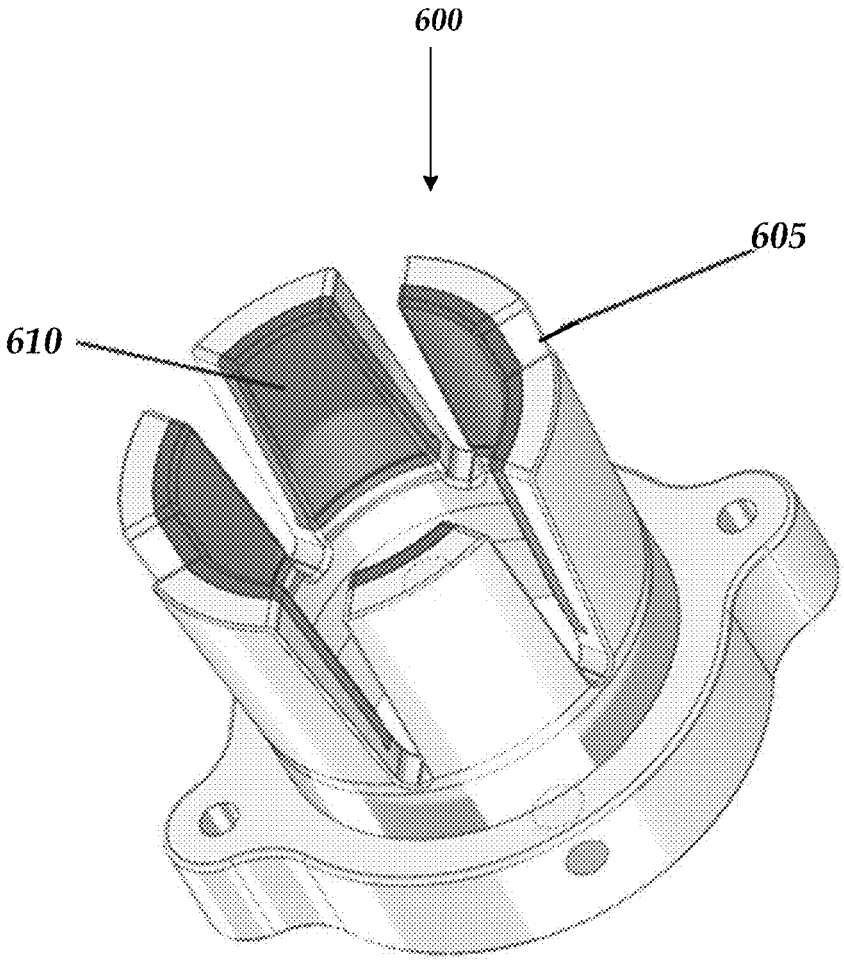
FIG. 6 shows a depiction of a braking mechanism for use in an assistive mobility device in accordance with an exemplary embodiment of the present disclosure.
Figure 7:
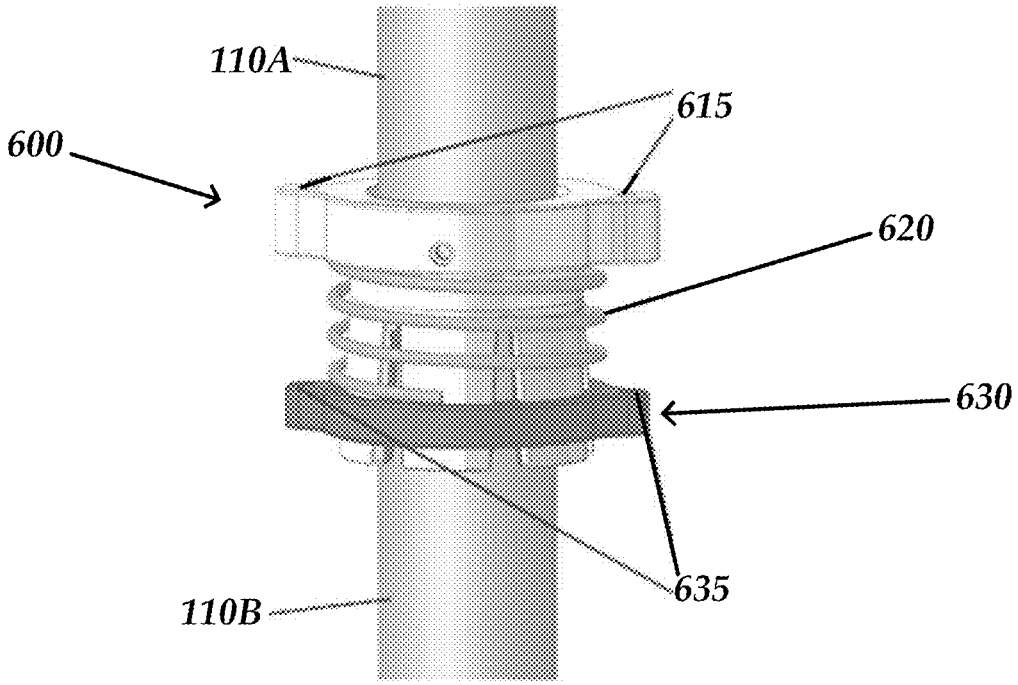
FIG. 7 shows a depiction of a braking mechanism for use in an assistive mobility device in accordance with an exemplary embodiment of the present disclosure.
Figure 8:
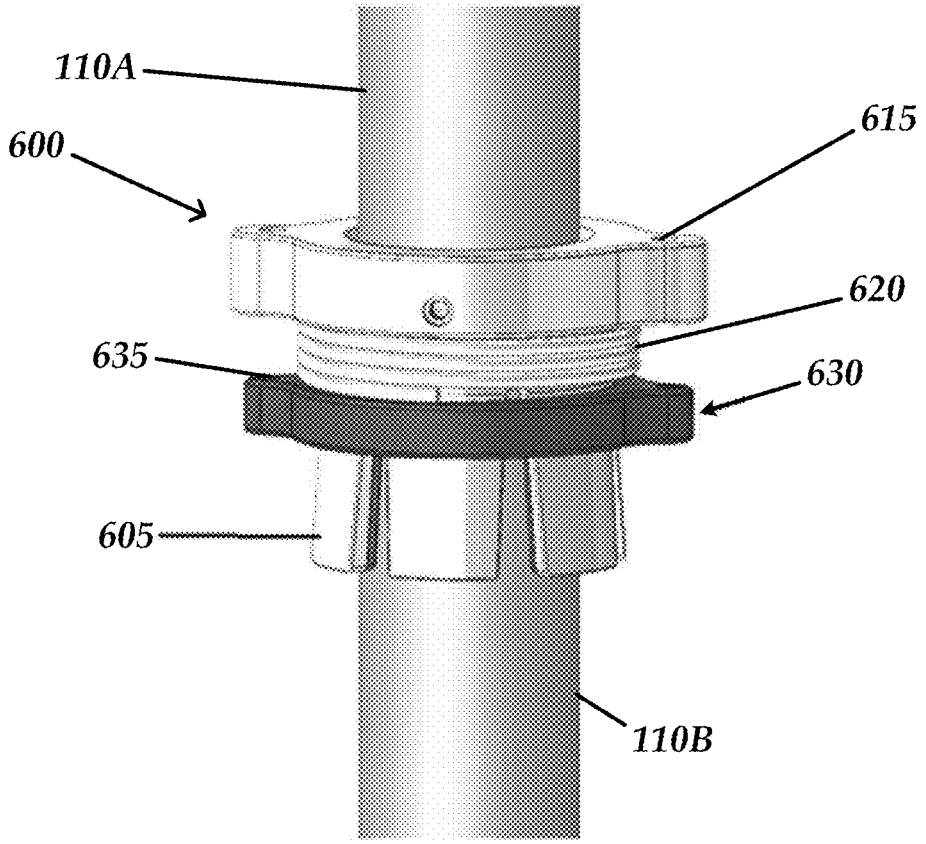
FIG. 8 shows a depiction of a braking mechanism for use in an assistive mobility device in accordance with an exemplary embodiment of the present disclosure.
Figure 9:
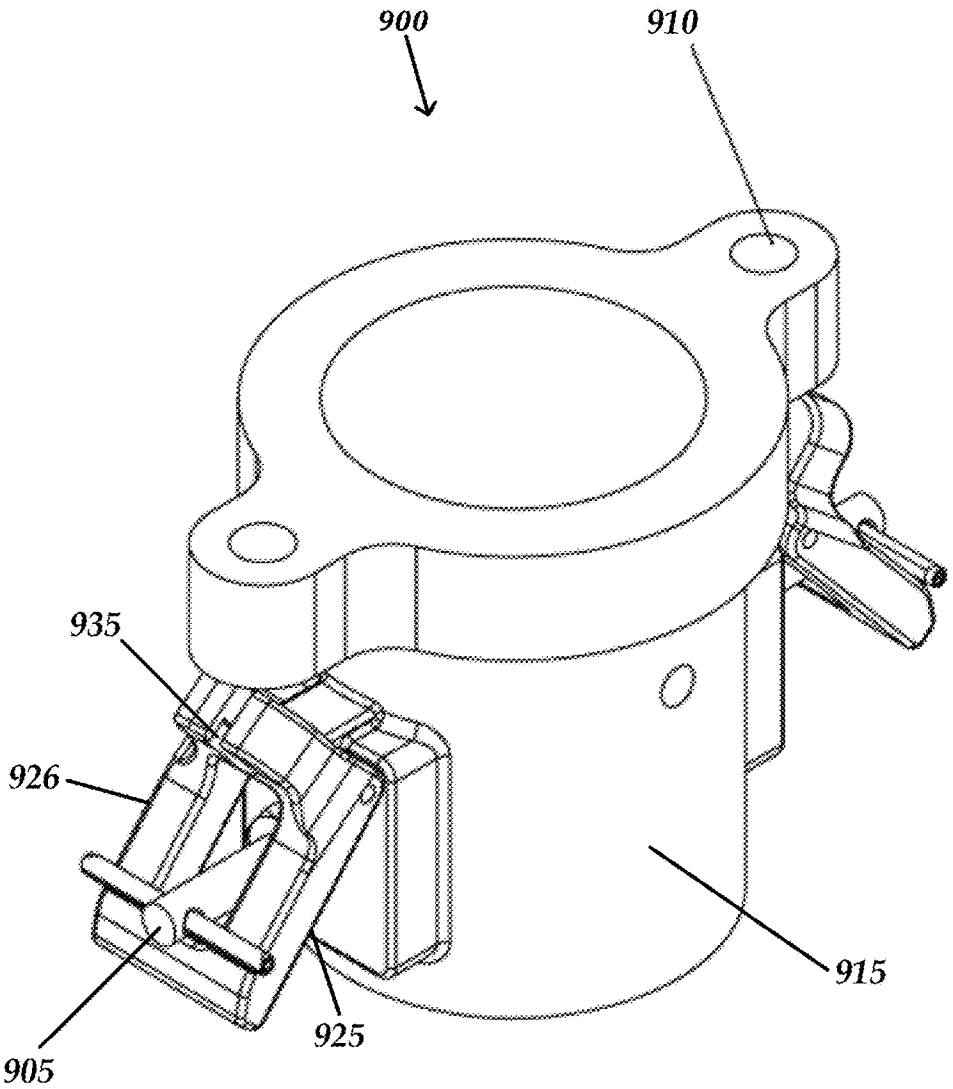
FIG. 9 shows a depiction of a braking mechanism for use in an assistive mobility device in accordance with an exemplary embodiment of the present disclosure.
Figure 10A:
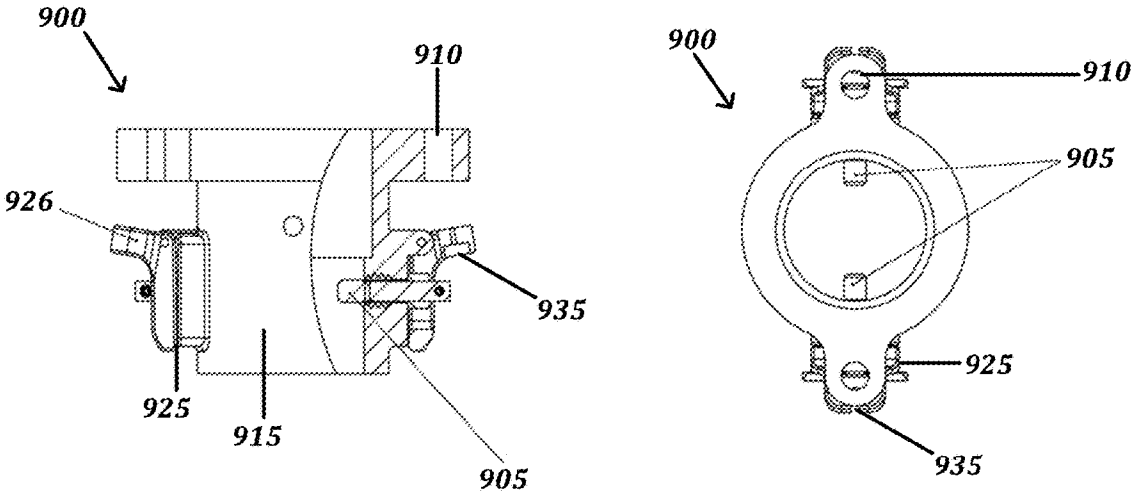
FIGS. 10A-10B show depictions of a braking mechanism for use in an assistive mobility device in accordance with an exemplary embodiment of the present disclosure.
Figure 10B:
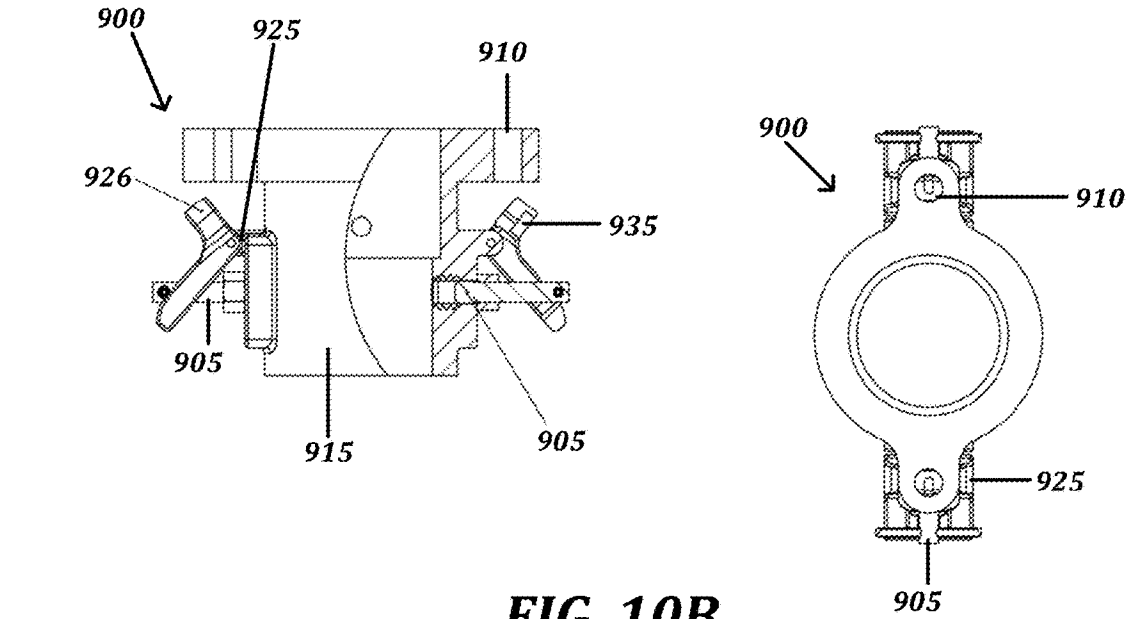

In some embodiments, the braking mechanism may comprise a plurality of gripping members for releasably securing or locking the extendable portion of the leg. By way of non-limiting example, FIGS. 6-8 show an exemplary braking mechanism 600 comprising a plurality of gripping members 605 including gripping area 610 configured to be grippingly secured against an outer surface of the extendable portion 110B of the upper leg portion 110A, for example, effective to maintain the extendable portion at a fixed position and leg length. As shown in FIG. 6, the gripping members 605 are configured to flex outward in the absence of a compression source. As shown in FIG. 7, the gripping members 605 are releasably secured against an outer surface of the extendable portion 110B in the locked state using a compression element 630 or other means for forcibly securing the gripping members 605 against the outer surface of the extendable portion 110B effective to maintain the extendable portion in a locked state. The compression element 630 comprises a locked position and an unlocked position, and is shown in the form of a compression ring disposed around the outer surfaces of the gripping members 605. As shown in FIG. 7, the compression element locked position may correspond to a position along the gripping members 605 effective to forcibly securing the gripping members 605 against the outer surface of the extendable portion 110B. As shown in FIG. 8, the compression element unlocked position may correspond to a position along the gripping members 605 effective to allow the gripping members 605 to flex outward from the extendable portion 110B to allow travel and adjustment of the extendable portion 110B relative to the upper leg portion 110A. In other aspects, a spring or tension element 620 or other means for producing a force effective to releasably maintain the compression element 630 in a locked position can be employed. In further aspects, an actuator in operable and/or mechanical communication with the compression element may be configured to move or pull the compression element from a locked position to an unlocked position. For example, an actuator in operable communication with a brake line, carrying a cable therein, mounted to line connection point 615 would pull said cable connected to cable connection points 635 to pull up compression ring 630 into the unlocked position.

In other embodiments, the braking mechanism may comprise a plurality of locking members for releasably locking the extendable portion of the leg at a fixed position and leg length. In further aspects, the plurality of locking members may be configured to be releasably inserted into one or more apertures disposed on a surface of the extendable portion of the leg to lock the position of extendable portion in the locked state. The plurality of locking members may be configured to be retracted out from the apertures of the extendable portion of the leg into the unlocked state to thereby allow travel of the extendable portion and adjustment of the leg length. In further aspects, the plurality of locking members may be releasably secured in the apertures of the extendable portion of the leg in the locked state using a compression element or other means for forcibly driving the locking members towards the apertures of the extendable portion effective to maintain the extendable portion in a locked state. Similarly, the compression element of this embodiment may include a locked position and an unlocked position.

Figure 11C:
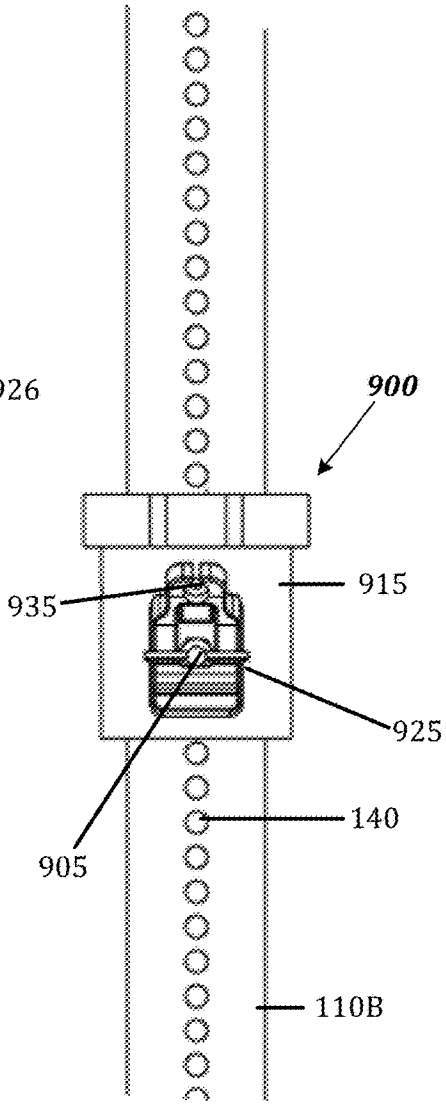
FIGS. 11A-11C show depictions of a braking mechanism for use in an assistive mobility device in accordance with an exemplary embodiment of the present disclosure.
Figure 11B:
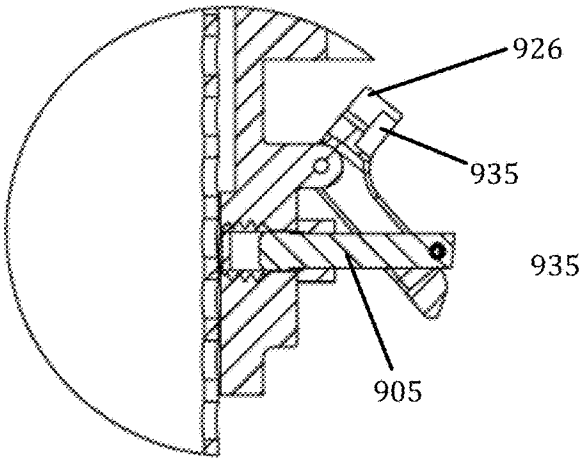
Figure 11A:
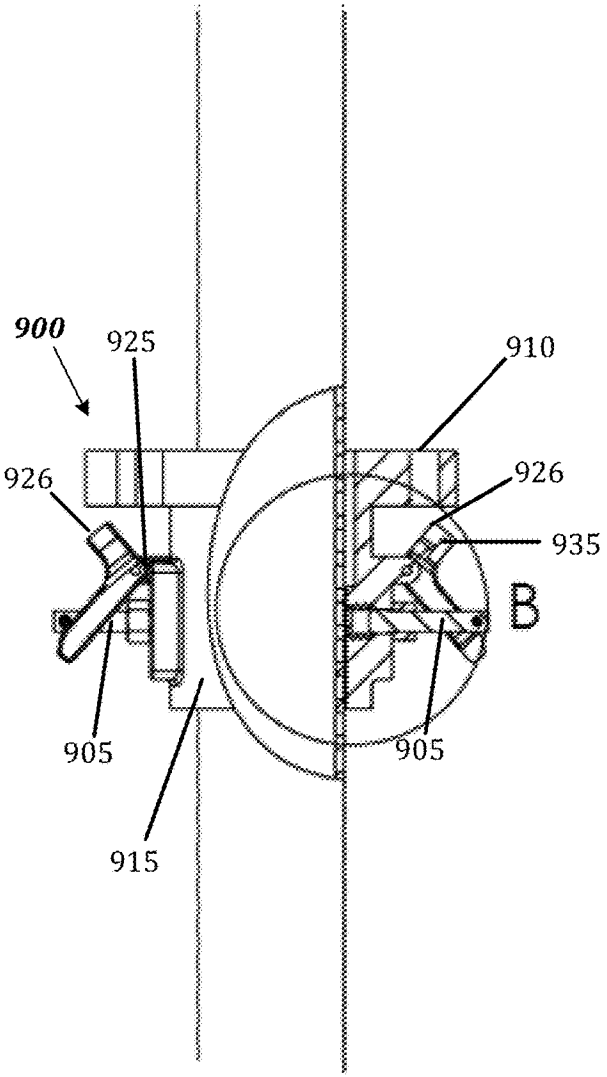

FIGS. 9-11C show another exemplary braking mechanism 900 comprising a braking mechanism body 915, and spring plunger 925 with two locking members 905 configured to be releasably inserted into apertures 140 disposed on a surface of the extendable portion 110B of the leg to lock the extendable portion in the locked state and fixed position. Spring plunger 925 is disposed on an outer surface of the braking mechanism body 915 and is in mechanical communication with the locking members 905 to drive or force the locking member towards the apertures 140 of the extendable portion 110B of the leg. Spring plunger 925 may be hingedly or pivotably attached to allow movement between locked and unlocked positions. As shown in FIGS. 10A and 11C, the locked position corresponds to a position where the movable portion 926 of the spring plunger 925 is on or sufficiently near the braking mechanism body 915 effective to cause at least a portion of the connected locking member 905 to be inserted into an aperture of the extendable portion effective to lock the extendable portion of the leg at a fixed position corresponding to a leg length. As shown in FIGS. 10B and 11A, the unlocked position may correspond to a position where the movable portion 926 of the spring plunger 925 is sufficiently retracted or rotated away from the braking mechanism body 915 effective to retract the locking member from within the apertures of the extendable portion to allow travel of the extendable portion and adjustment of the leg length. The spring plunger may comprise a spring or tension element or other means for producing a force effective to maintain the plunger and/or locking members in a locked position. An actuator (not shown) in operable communication with a brake line, carrying a cable therein, mounted to line connection point 910 would pull said cable connected to cable connection points 935 to pull up the movable portion 926 of spring plunger 925 into the unlocked position.

As described herein, one or more actuators may be located on the frame assembly in operable and/or mechanical communication with braking mechanism to move or otherwise change the braking mechanism from a locked position to an unlocked position. For example, in some aspects, the actuator may be configured to move or pull a compression ring from a locked position to an unlocked position. In other aspects, the actuator may be configured to move or otherwise pull or tilt the movable portion of a spring plunger into an unlocked position from the locked position. In yet further aspects, each side frame may comprise an actuator for controlling their respective legs. As shown with respect to FIG. 2, a single actuator may be in operable communication with the braking mechanism of both the first and second legs of a side frame. In still further aspects, the actuator may be configured to simultaneously control operation of the braking mechanism of both the first and second legs. For example, the actuator may be configured to simultaneously unlock or release the braking mechanism of both the first and second legs. In some aspects, the frame assembly may comprise first and second actuators in operable communication with the braking mechanisms on the first and second side frames respectively. In some aspects, the device can be configured to allow the leg length to be selectively adjusted by a user with the first and second actuators while grasping the gripping members during use. In other aspects, the actuator may comprise a lever, switch, handle, knob, trigger, and/or other means for controlling operation and/or changing positions of the braking mechanism.

In various aspects, the device includes a leg adjustment mechanism or system configured to self-adjust a leg in response to the user changing the length of the adjacent leg. In further aspects, the leg adjustment system may include one or more spring or tension elements (i.e., compression spring) that extend through a portion of each leg and configured to exert a predetermined and/or constant amount of force against the extendable portion of the leg, and a cable connecting the extendable portion of the first leg with the extendable portion of the second leg. The cable may have a predetermined length and may be configured to limit travel of one or both of the extendable portions. In further aspects, the leg adjustment system may extend from an upper portion of a first leg through the gripping member into the upper portion of the second leg. The leg adjustment system may comprise an internal sheath or housing configured to contain the cable. In further aspects, the leg adjustment system may be configured to maintain a leg length adjustment ratio between the first and second legs of about 1:1. In still further aspects, the tension element may be configured to force the extendable portion of the leg to extend outward or downward (i.e., lengthen) from within the fixed upper leg portion. In even further aspects, the tension element may extend through a portion of each leg. In yet further aspects, the leg adjustment system may be configured to maintain a 1:1 leg length adjustment ratio between the first and second legs. In still further aspects, the leg adjustment system may be configured to maintain a 1:1 travel ratio between the extendable portions of the first and second legs. In even further aspects, the leg adjustment system may be configured to lengthen one leg at a 1:1 ratio in response to the user shortening the other leg of the side frame. In further aspects, the tension elements and cable may cooperate to maintain a length adjustment ratio between the first and second legs, for example, about a 1:1 length adjustment ratio. In still further aspects, the tension elements and cable may cooperate to maintain a travel ratio between the extendable portion of the first and second legs, for example about a 1:1 travel ratio.

In further aspects, the travel ratio can correspond to the ratio of the inward travel distance of the extendable portion of a shorten leg to the outward travel distance of the extendable portion of the lengthened leg of the same side frame. In yet further aspects, the travel ratio can be from about 1:0.1 to about 1:2 or 1:0.5 to about 1:1.5, including exemplary ratios of 1:0.6, 1:0.7, 1:0.8, 1:0.9, 1:1, 1:1.1, 1:1.2, 1:1.3, and 1:1.4 and any subranges therebetween.

In further aspects, the leg adjustment system may comprise at least one retention element. In still further aspects, the retention element may be attached within an upper portion of each of the first and second legs. In yet further aspects, the retention element may comprise at least one aperture configured to allow passage of the cable and/or provide a connection point for the cable. In even further aspects, the retention element may comprise an aperture wherein the cable is secured within the aperture or at a point immediately after passing through the aperture. The retention element may also comprise an attachment point for connecting an end of the tension element or compression spring. In some aspects, a retention element may be attached to the first ends of the extendable portions of each of the first and second legs. In other aspects, a retention element may be attached within the first ends of the extendable portions of each of the first and second legs. In further aspects, a retention element may be attached within an upper portion of each of the first and second legs with a retention element attached to the first ends of the extendable portions of each of the first and second legs. In yet further aspects, a first retention element may be attached within an upper portion of each of the first and second legs, and a second retention element may be attached to the first ends of the extendable portions of each of the first and second legs. To this end, a fixed retention element and the first end of the extendable portion of the leg may define a space within the leg for containing the tension element or compression spring. In further aspects, the first end of the tension element may be connected to a first retention element and a second end of the tension element may be connected to a second retention element. In yet further aspects, the first retention element may be fixed and the second retention element may be configured to move with the extendable portion of the leg. In even further aspects, the first retention element may comprise an aperture to allow passage of the cable and the second retention element may comprise an attachment point for securing the cable of the leg adjustment system. In some aspects, the left front leg and the left rear leg are connected to one another using one cable and the right front leg and the right rear leg are connected to one another using another cable. In other aspects, the cable may comprise a tendon, filament, line, flexible rod, line or other tensile element.

Figure 12:
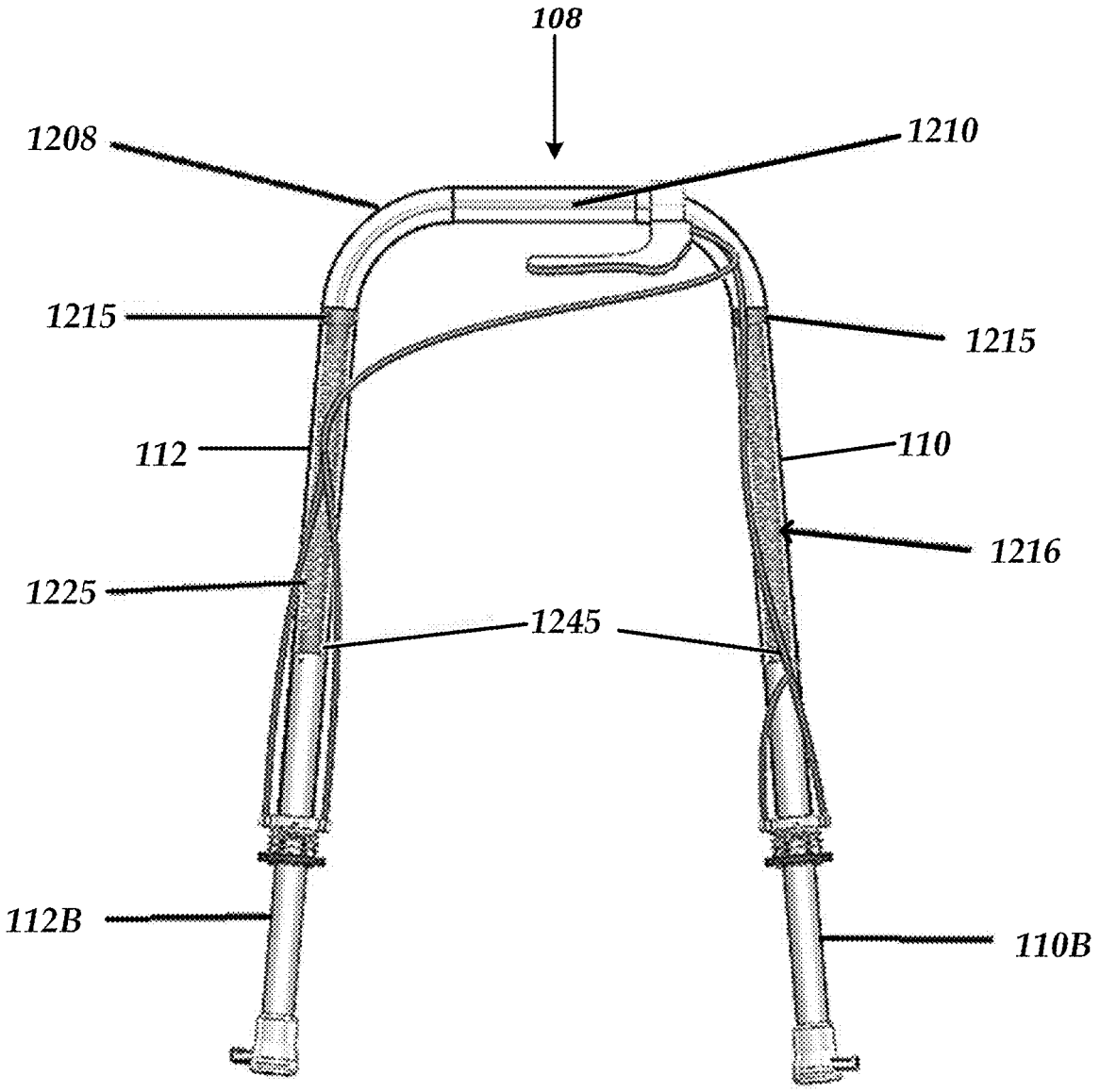
FIG. 12 shows a depiction of a leg adjustment system for use in an assistive mobility device in accordance with an exemplary embodiment of the present disclosure.
Figures 13A, 13B:
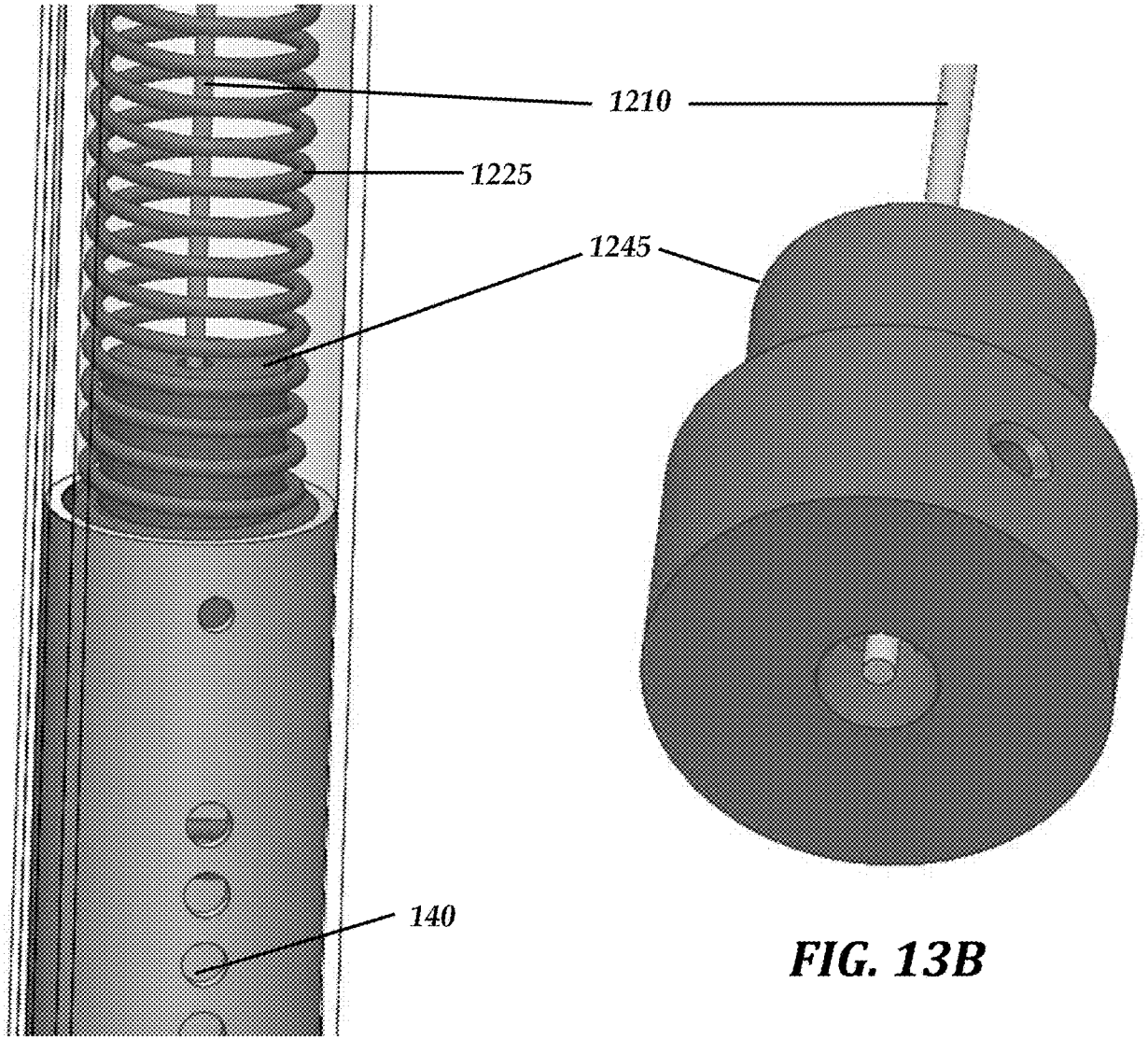
FIGS. 13A-13B show depiction of retention element employed in a leg adjustment system for use in an assistive mobility device in accordance with an exemplary embodiment of the present disclosure.
Figure 14:
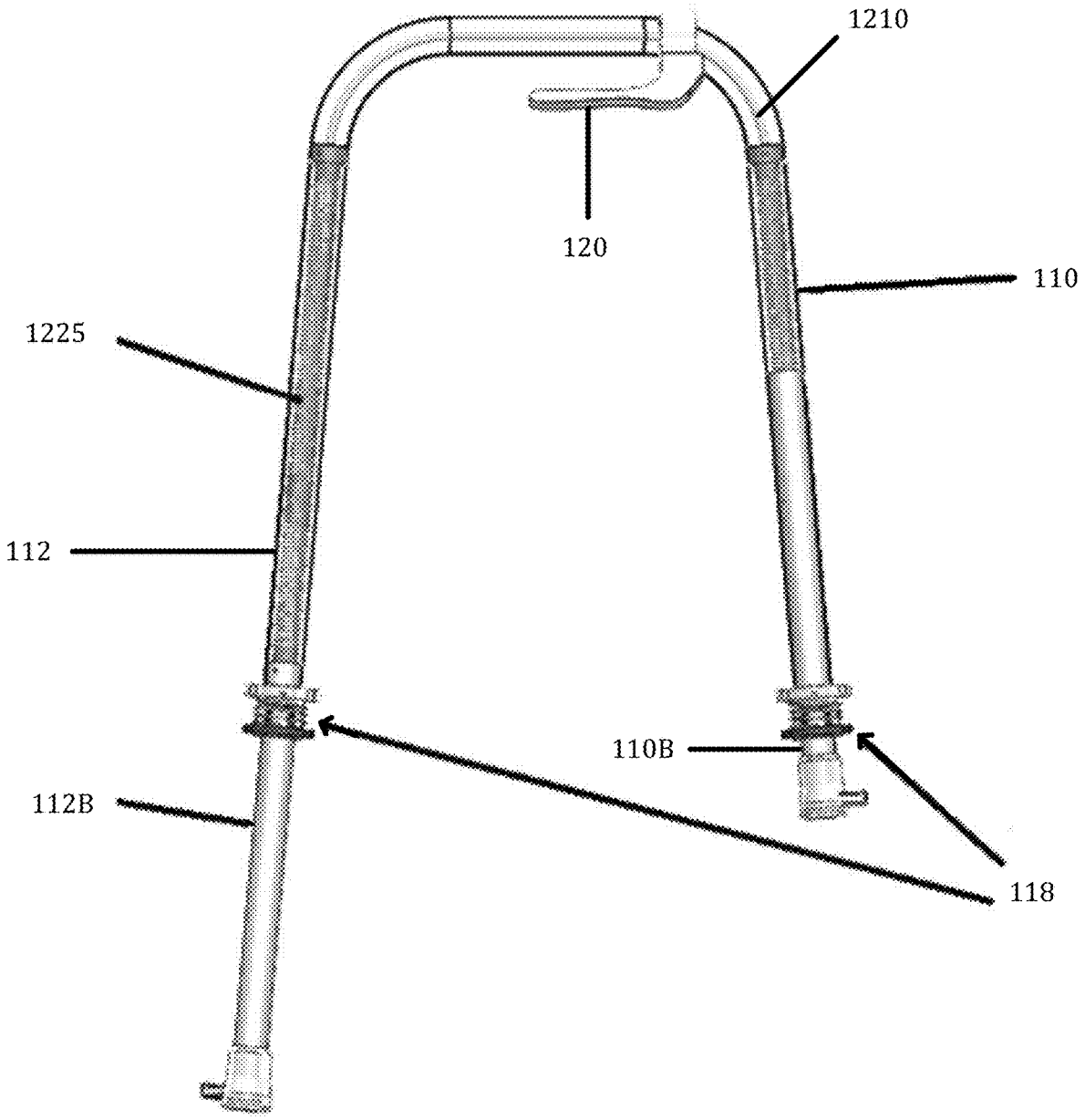
FIG. 14 shows a depiction of operation a leg adjustment system for use in an assistive mobility device in accordance with an exemplary embodiment of the present disclosure.
Figure 15:
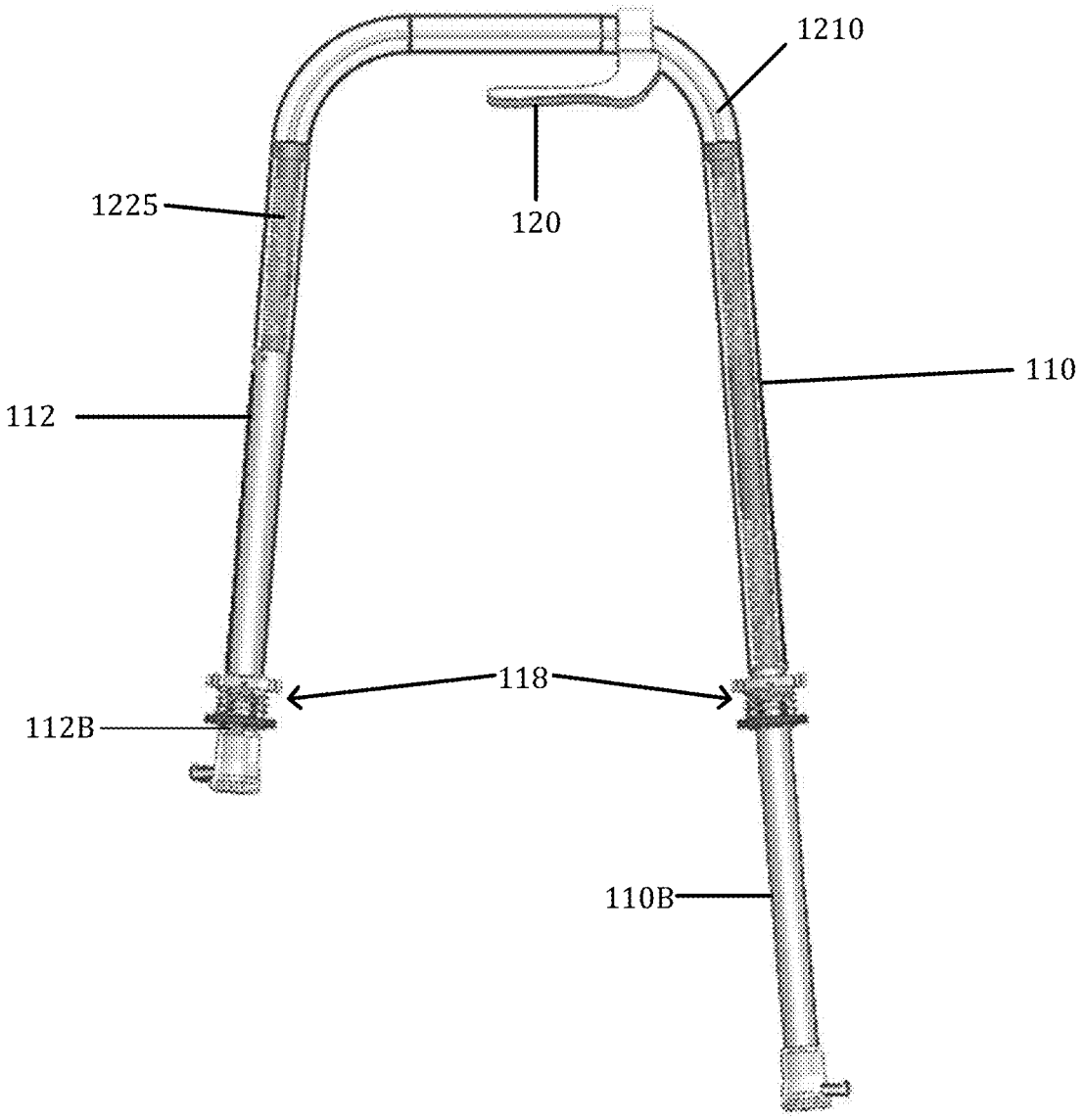
FIG. 15 shows a depiction of operation of a leg adjustment system for use in an assistive mobility device in accordance with an exemplary embodiment of the present disclosure.

FIGS. 12-15 show an exemplary self-adjusting leg adjustment system and operating elements employed in the device and systems of the present invention. FIG. 12 shows leg adjustment system 1216 within side frame 108 which is configured to self-adjust one leg at a leg length adjustment ratio in response to shortening of the leg. Leg adjustment system 1216 comprises constant force compression springs 1225 that extend through the upper leg portions 110A, 112A of each leg and exerts a predetermined amount of force against the extendable portions 110B, 112B of the leg, and connecting cable 1210 connecting the front extendable portion 110B with the rear extendable portion 112B. Cable 1210 has a predetermined length for limiting travel of one or both of the extendable portions. The leg adjustment system comprise an internal sheath or housing configured to contain cable 1210, such as shown in the gripping member. A first fixed retention element 1215 is attached within an upper portion of each of the front leg 110 and rear leg 112, and a second retention element 1245 is attached to the first ends of the front extendable portion 110B and rear extendable portion 112B. The first retention element 1215 and the second retention element 1245 define a space within the leg for containing compression spring 1225, the first end of the compression spring 1225 being connected to first retention element 1215 and the second end of compression spring 1225 being connected to second retention element 1245. First retention element 1215 comprises an aperture to allow passage of cable 1210 and second retention element 1245 comprise aperture for to allow insertion and attachment of cable 1210, as shown in FIGS. 13A and 13B. Second retaining element 1245 is attached within the extendable portion, and thus, may move with the extendable portion of the leg. FIG. 14 shows operation of the leg adjustment system in connection with shortening of the front leg 110, such as would be done to traverse up the stairs. To this end, a user would first actuate brake handle 120 in order to release braking mechanism 118, and then press down on a portion the frame assembly to retract front extendable portion 110B into the front leg 110 which compresses spring 1225. Compressing spring 1225 and retraction of front extendable portion creates slack in cable 1210, and thus, allows travel for the rear extendable portion 112B leg connected to the second end of cable 1210. Once the slack in cable 1210, and corresponding travel distance, is created, spring 1225 in rear upper leg portion 112A can expand and act on rear extendable portion 112B to extend out the leg up to a distance equal to the distance front extendable portion 110B was retracted. To this end, the compression springs 1225 and cable 1210 cooperate to provide leg movement between the legs in a fixed ratio, such as, 1:1. User can then release brake handle 120 to return braking mechanism 118 to a locked position and secure the leg at their respective lengths. As shown in FIG. 15, au user can perform the same procedure to shorten the rear extendable portion 112B of rear leg 112, such when going down the stairs.

In various aspects, the device component characteristics and configuration, such as, for example, size and dimensions, can be configured to adjust for an individual user's height, weight, disease state, and other factors to achieve optimal operating height, load balancing and/or stability. In further aspects, features of the device and components may be configured or utilized to set and/or control the characteristics. For example, at least one of the following may be configured: the type of material used for the frame assembly and leg; the extendable leg member dimensions (e.g., height, width, thickness, surface-contacting area, etc.); the flexibility or tensile of the connector cable; the force transmission characteristics of the tension elements; and the extent of exterior surface coverage of surface-contacting portion of the foot or lower end of extendable portion. In further aspects, the assistive devices may include an impact-dampening component or material. In further aspects, the assistive devices can utilize the mechanical properties and benefits of the impact-dampening component for shock absorption. In still further aspects, the impact-dampening component can comprise a spring or shock or other shock absorbing materials, such as, for example, gels, air, gas, hydraulic, foam, a combination thereof or the like.

In further aspects, the spring or tension element may comprise a spring-assist mechanism, such as and without limitation, a compression spring, extension spring, constant force spring, retraction spring, power spring, elastic retractor, torsion spring, or a combination thereof. While the disclosed embodiments of the leg adjustment system utilize spring-assisted-mechanisms for adjusting or extending the extendable portion of the leg, for example, in response to shortening of an adjacent leg, this is not a requirement. In some embodiments, the leg adjustment system may utilize, in lieu of or in addition to the spring-assisted mechanism, a motorized or other powered means for moving the extendable portion of the leg. In still further aspects, the motorized or powered means may comprise a power transmission component such as an electromechanical actuator, motor, belt and pulley, linear actuator, screw drive, rotational motor with linkage, rack and pinion, pneumatic, electromagnetic, hydraulic, and the like. In yet further aspects, the device can comprise a power source configured to provide power one or more device components, such as, a rechargeable or replaceable battery. In even further aspects, the disclosed devices may further comprise one or more of the following components: a voltage regulator, power switch, power management module, battery management module (e.g., fuel gauge), battery charging module, wireless power coil or receiver, wireless power control module, antenna, transceiver, motor controller, interface module, voltage sensor, current sensor, modulation module, and power input.

In further aspects, the power transmission component (and/or spring-assist mechanism) may be configured to move or drive the extendable portion of a leg to a stop position from a start position. In still further aspects, the stop position may comprise a forward travel limit for the extendable leg portion. In yet further aspects, the travel distance between a start position and stop position may define a travel limit of the coupled extendible leg portion. In some aspects, the forward travel limit may be equal to travel distance of the shortened extendible leg portion. In other aspects, the forward travel limit may be equal to or less than travel distance of the shortened extendible leg portion.

In various aspects, the retention element and connecting cable of the leg adjustment system cooperate to provide a stopping mechanism that may be configured to control movement or travel, such as forward travel (or extension) of at least one extendable portion of a leg on a side frame. In still further aspects, the stopping mechanism may be configured to stop forward travel of the one extendable portion by preventing the cable connected to the other extendible portion from passing through the retention element.

In further aspects, while certain components of the disclosed devices described herein can be permanently mounted in or on the frame assembly, this is not a requirement. For example, the extendable portion of the leg can be configured to be removably inserted into the upper leg portion, e.g., to allow interchange and/or replacement of the extendable portion. Such configurations allow users, health care professionals, caretakers, retailers, or others to select desired properties or levels in a device structure, e.g., for customization purposes, for personal preferences, to match desired treatment use, a user's physical characteristics, such as height, a user's symptoms, or to repair or replace defective or damaged device portions, etc. In further aspects, the assistive device may utilize a plurality of interchangeable members for the extendable portion of the leg so as to accommodate different height of users, for example, a small size covers a first range of heights, a medium size covering a second range of heights, and large size covering a third range of heights. To this end, the disclosed assistive device can be used by users ranging in height from about 4' 6" to about 6'6", for example, about 5' to about 6' 3". In still further aspects, the frame assembly and members may be comprised of a light weight, strong, material, such as aluminum, plastic, composite, or other material capable of being rated for use by users up to 300 lbs.

Further, the foot and/or foot attachment component can be configured to be removably attached to the end of the leg. Thus, according to further aspects, the present disclosure also provides a retrofittable stability system comprising the foot and/or foot attachment component for walkers and assistive mobility device.

In various aspects, the components of the disclosed devices and components can be detachably attached. In further aspects, the components can be connected by a connecting means. In still further aspects, the connecting means can comprise a fitting, insert, adhesive, brazing, soldering, welding, spot weld, screw with nut, rivet, threading, friction fit, snap-fit, twist-lock, or interlocking mechanism or a combination thereof. In yet further aspects, the connection can be achieved using a snap, friction fitting, snap ring, O-ring, pressure fitting, clip, clasp, and the like. The snap ring or O-ring can be retained within a groove to accommodate the snap ring or O-ring. In a further aspect, the system can comprise an engagement means for coupling and holding components together. In a further aspect, the engagement means can be a screwing mechanism, a click-lock mechanism, or friction mechanism, or the like. In still further aspects, the device and system components can be integrally or mechanically attached to other components. In a yet further aspect, the disclosed components can be connected, attached, or mounted using a connecting means, the connecting means comprising a fitting, insert, adhesive, brazing, soldering, welding, spot weld, screw with nut, rivet, fitting, insert, threading, friction fit, or snap-fit or a combination thereof.

According to various aspects of the disclosure, the devices and systems of the present invention provides a number of advantages over current options. The combination of inventive configurations, device construction and positioning allow the disclosed assistive devices and systems to be more effective in traversing stairs. According to various embodiments, the present invention provides secure fixation for the assistive devices to help the user propel themselves up or down the stairs safely. Once at the top or bottom of the stairs, the legs of the device can then be adjusted back to standard walker leg lengths using the self-adjusting leg mechanism to allow for ambulation on flat surfaces.

Also disclosed herein are methods of using the disclosed devices and systems. For example, in another exemplary aspect, the present disclosure provides a method for ambulating or traversing an incline and/or decline using a disclosed device or system. In further aspects, the incline and/or decline may be stairs. In one aspect, the disclosed method can comprise one or more of: ascending a platform using a disclosed device; adjusting a length of a leg of the device, for example, to accommodate a given stair profile and/or attach to a stabilizing component; securing the frame assembly and/or leg into a guide or stabilizing component; supporting shifting body weight using the device; moving the device to a next platform level or stair; and adjusting the lengths of the leg for a flat surface.

Figure 16:
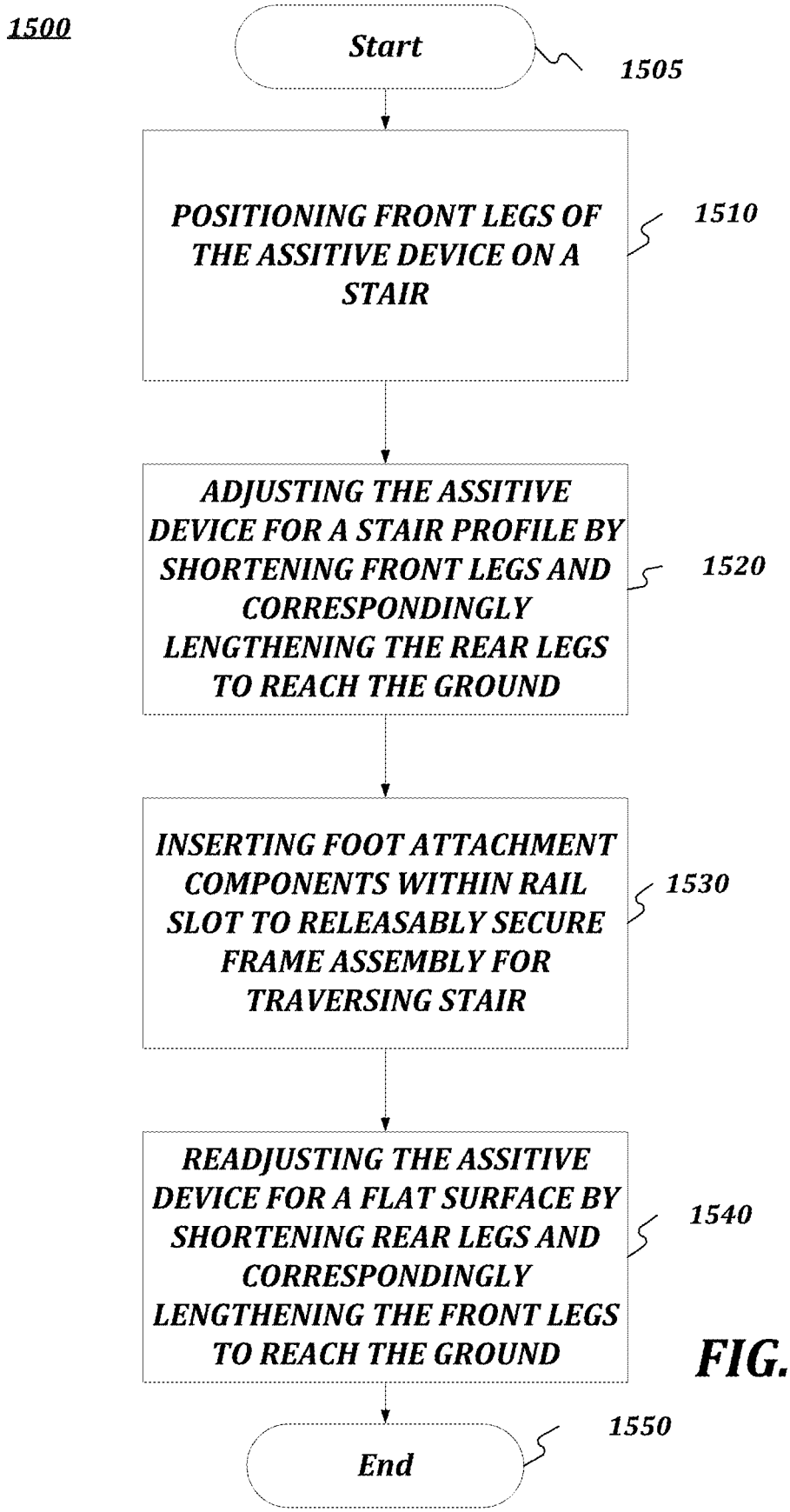
FIG. 16 is a flow chart of a method for assisted traversing of stairs using an assistive mobility system in accordance with an exemplary embodiment of the present disclosure.

FIG. 16 is a flow chart setting forth the general stages involved in a method 1500 consistent with an embodiment of the disclosure for operating the disclosed devices and systems. Method 1500 may be implemented using, at least in part, assistive mobility device 102 and/or stabilizing component 104 as described in more detail with respect to FIG. 1.

Device 102 may comprise actuating brake handle 120 for operating the device components, and as such, actuating brake handle 120 may be in operative configuration and communication with, for example, but not be limited to, braking mechanism 118 and leg adjustment system 116. In other embodiments, leg adjustment system 118 may be completely self-operating upon configuration, such as, for example, to automatically adjust the rear leg length in response to the user adjusting the front leg length, and vice versa. Furthermore, although stages are disclosed with reference to assistive mobility device 102 and/or stabilizing component 104, it should be understood that other disclosed device embodiments may enable the operation of method 1500, including, but not limited to, other device mechanisms, mechanical components, environment properties (e.g., stair types), user conditions, and the like.

Further still, although the stages illustrated by the flow charts are disclosed in a particular order, it should be understood that the order is disclosed for illustrative purposes only. Stages may be combined, separated, reordered, and various intermediary stages may exist. Accordingly, it should be understood that the various stages illustrated within the flow chart may be, in various embodiments, performed in arrangements that differ from the ones illustrated. Moreover, various stages may be added or removed from the flow charts without altering or deterring from the fundamental scope of the depicted methods and systems disclosed herein.

Method 1500 may begin at starting block 1505 and proceed to stage 1510, where the front of the assistive device may be placed on a stair to adjust the front legs. From stage 1510, where the device is positioned on the stairs, method 1500 may proceed to stage 1520 where the patient or user prepares to ascend the stairs, they may compress the actuating brake handle toward the gripping member of the frame assembly to release the braking mechanisms. Upon unlocking the braking mechanism, the extendable portion of the legs will be in an unlocked state and the leg adjustment system and components will be active. With the front legs placed on the first stair, the user can then press down on the corresponding portion of the frame assembly to shorten the front legs. The leg adjustment system then works to self-adjustingly lengthen the rear legs to reach the ground, at which time the user can release the brake handle to lock the extendable leg portions in place.

From stage 1520, where the device legs have been adjusted for the stair profile, method 1500 may proceed to stage 1530, where the user may then insert the foot attachment component of the frame assembly within the slot of the rail on the first step for stabilization. The stabilizing effect of this attachment can then allow the user to safely use the frame assembly to pull themselves upward to the first step. In some embodiments, the front cross support may be bowed away from the user to allow for their body to come forward and not contact the frame assembly. This step may be repeated for each step until the top is reached. From stage 1530, where the device is used to traverse the stairs, method 1500 may proceed to stage 1540, where once the user has reached the top the steps, they may compress the brake handle again release the braking mechanism to allow the user to press down on a corresponding portion of the frame assembly to shorten the back legs until both front and back legs become parallel and safe for use on flat surfaces. After stage 1540, method 1500 may end at stage 1550.

In further aspects, a patient or user may follow method 1500 to traverse up or down a series of stairs, by then disengaging the foot and progressively reengaging the next step moving upwards or downwards. As aforementioned, when descending stairs, the same process occurs; however, when compressing the brake handle the user shortens the rear legs and allows the forward legs to lengthen. When engaging the stabilizing rail of the stair during descent, the foot attachment component on the rear legs, which face backwards, lock into the slot of the rail to stabilize the walker and allow the user to safely descend the stairs. At the bottom of the stairs, the brake handle may once more be compressed in order adjust the legs into a position and leg lengths for that flat surface.

While method 1500 describes a method for traversing stairs, an advantage of the invention can be that it allows a user to use the device as both a standard walker or self-adjusting walker for traversing stairs. To this end, as a standard assistive device, the self-adjusting device may also be used to allow the user to completely off load the weight of an affected limb by hopping on the usable limb and stabilizing and propelling them forward with the device.

Also disclosed herein are kits comprising the disclosed assistive devices. For example, in an exemplary aspect, the present disclosure provides an assistive mobility kit comprising: a disclosed assistive mobility device; and instructions for using the assistive mobility device in connection with a method of ambulating and/or traversing stairs. In further aspects, the instruction and/or method may comprise any method and/or method step disclosed herein. In still further aspects, the method and/or method step may comprise affixing a disclosed stabilizing component, such as slotted rail capable of securely coupling with the assistive device, to a fixed object, such as, a portion of a stair. In even further aspects, the method and/or method step can involve releasably attaching the assistive mobility device to the stabilizing component, for example, in connection with traversing stairs.

The present invention includes at least the following aspects: Aspect 1: An assistive mobility device comprising: a) a frame assembly comprising: a first side frame connected with a second side frame, each side frame comprising: first and second legs each having first and second opposed ends, and a gripping member connecting first ends of the first and second legs, the second ends of first and second legs having an extendable portion configured to allow selective adjustment of a leg length; a leg adjustment system contained within a portion of each side frame configured to correspondingly lengthen one leg at a leg length adjustment ratio in response to shortening of another leg; at least one braking or locking mechanism in mechanical communication with the extendable portion of each leg configured to releasably secure the extendable portion of the leg, such as in a locked state, at a fixed leg length; ii) at least one actuator in operable communication with the at least one braking mechanism configured to selectively release the extendable portion of each leg from a locked state to allow adjustment of the leg length; at least one cross support having first and second ends connecting the first side frame with the second side frame; wherein the frame assembly is configured to releasably attach to a fixed object for stabilizing the frame assembly effective to allow a user to propel themselves upwards by pulling on the frame assembly when ascending up an incline.

Aspect 2: An assistive mobility system comprising: an assistive mobility device configured to releasably attach to a fixed object, the assistive mobility device comprising: a frame assembly comprising: a first side frame connected with a second side frame, each side frame comprising: first and second legs each having first and second opposed ends, and a gripping member connecting first ends of the first and second legs, the second ends of first and second legs having an extendable portion configured to allow selective adjustment of a leg length, the extendable portion having an attachment component configured to releasably attach to a stabilizing component; a leg adjustment system contained within a portion of each side frame configured to correspondingly lengthen one leg at a leg length adjustment ratio in response to shortening of another leg; at least one braking or locking mechanism in mechanical communication with the extendable portion of each leg configured to releasably secure the extendable portion of the leg, such as in a locked state at a fixed leg length; at least one actuator in operable communication with the at least one braking mechanism for selectively releasing the extendable portion of each leg, such as from a locked state to an unlocked state, to allow adjustment of the leg length; at least one cross support having first and second ends connecting the first side frame with the second side frame; and a stabilizing component configured to releasably attach with the attachment component for stabilizing the assistive mobility device effective to allow a user to propel themselves upwards by pulling on the frame assembly when ascending up an incline.

Aspect 3: The device of any preceding aspect, wherein each pair of side frames are arranged in left and right pairs.

Aspect 4: The device of any preceding aspect, wherein the first side frame comprises a left side frame and the second side frame comprises a right side frame.

Aspect 5: The device of any preceding aspect, wherein each side frame comprises at least one side cross support connecting the first leg with the second leg.

Aspect 6: The device of any preceding aspect, wherein the frame assembly cross support comprises a substantially horizontal crossmember extending between the first and second side frames.

Aspect 7: The device of any preceding aspect, wherein the frame assembly cross support comprises a substantially horizontal crossmember connected to and extending between the front leg of the first side frame and the front leg of the second side frame.

Aspect 8: The device of any preceding aspect, wherein the side cross support comprises a substantially horizontal crossmember extending between the first and second side legs and/or a substantially diagonal crossmember extending between the first and second side legs.

Aspect 9: The device of any preceding aspect, wherein the side cross support comprises a substantially horizontal and/or a substantially diagonal crossmember connected to and extending between the front leg of the side frame and the rear leg of the side frame.

Aspect 10: The device of any preceding aspect, wherein the cross support comprises a cross bar, member, beam, brace, and/or other means for providing structural support between the side frames and/or legs.

Aspect 11: The device of any preceding aspect, wherein each pair of first and second legs define a common vertical plane and are configured to intersect a vertical plane defined by the ends of the frame assembly cross support at a substantially perpendicular angle.

Aspect 12: The device of any preceding aspect, wherein the middle portion of frame assembly cross support is bowed outward to allow a user to for their bodies to come forward and not contact the front portion of the frame assembly.

Aspect 13: The device of any preceding aspect, wherein each side frame comprises at least one side cross support connecting the first leg with the second leg.

Aspect 14: The device of any preceding aspect, wherein each gripping member comprises opposed ends connected to upper first ends of each pair of front and rear (i.e., first and second) legs.

Aspect 15: The device of any preceding aspect, wherein each gripping member extends between upper first ends of each pair of front and rear (i.e., first and second) legs.

Aspect 16: The device of any preceding aspect, wherein each gripping member comprises a gripping portion configured to be grasped by a user.

Aspect 17: The device of any preceding aspect, wherein each gripping member comprises a tubular member having a substantially U shape.

Aspect 18: The device of any preceding aspect, wherein the frame assembly is collapsible or foldable.

Aspect 19: The device of any preceding aspect, wherein the frame assembly is configured to collapse from an expanded state to a folded state.

Aspect 20: The device of any preceding aspect, wherein the frame assembly is configured to expand from a folded state to an expanded state.

Aspect 21: The device of any preceding aspect, wherein in the expanded state, the first and second side frames are connected to the frame assembly crossmember in a manner that defines a space for a user to occupy.

Aspect 22: The device of any preceding aspect, wherein the frame assembly comprises a locking mechanism configured to releasably secure the frame assembly in an expanded state.

Aspect 23: The device of any preceding aspect, wherein the first and second side frames are pivotably or hingedly connected to the front cross support of the frame assembly and wherein the side frames are collapsible against the front cross support.

Aspect 24: The device of any preceding aspect, wherein the side frame is pivotably or rotatably connected to an end of the front cross support; wherein said side frame is also connected to an end of the side cross support of the frame assembly; and wherein the end of the front cross support and the end of the side cross support cooperate to releasably secure the side frame in a locked state.

Aspect 25: The device of any preceding aspect, wherein an end of the front cross support and an end of the side cross support comprise a locking mechanism configured to releasably secure the side frame in a locked state.

Aspect 26: The device of any preceding aspect, wherein an end of the front cross support and an end of the side cross support comprise a complementary locking arrangement configured to releasably secure the side frame in a locked state.

Aspect 27: The device of any preceding aspect, wherein an end of the front cross support and an end of the side cross support comprise a tongue and groove arrangement configured to releasably secure the side frame in a locked state.

Aspect 28: The device of any preceding aspect, wherein the first side frame is rotatably connected to a first end of the front cross support of the frame assembly and fixedly connected to a first end of the first side cross support; the second side frame is rotatably connected to a second end of the front cross support and fixedly connected to a first end of the second side cross support; wherein the first end of the front cross support and the first end of the first side cross support cooperate to releasably secure the first side frame in a locked state; and wherein the second end of the front cross support and the first end of the second side cross support cooperate to releasably secure the second side frame in a locked state.

Aspect 29: The device of any preceding aspect, wherein the frame assembly comprises a spring or tension element or other means for producing a force effective to releasably maintain the side frame in a locked state.

Aspect 30: The device of any preceding aspect, wherein each leg comprises an upper leg member and a lower extendable member.

Aspect 31: The device of any preceding aspect, wherein each extendable portion comprises an extendable member having a first diameter adjustably connected to a corresponding portion of the leg comprising a leg member having a second diameter larger than the first diameter.

Aspect 32: The device of any preceding aspect, wherein the lower extendable member is slidably movable into the upper leg member.

Aspect 33: The device of any preceding aspect, wherein the first and second legs comprise telescoping tubular members;

Aspect 34: The device of any preceding aspect, wherein the telescoping members are arranged to radially extend and retract.

Aspect 35: The device of any preceding aspect, wherein each pair of first and second legs comprise substantially vertical front and rear side legs.

Aspect 36: The device of any preceding aspect, wherein the first and second legs of the first side frame comprises a left front leg and a left rear leg, respectively; and wherein the first and second legs of the second side frame comprises a right front leg and a right rear leg, respectively.

Aspect 37: The device of any preceding aspect, wherein the leg comprises a connecting element or attachment component or other connecting means for releasably attaching to a fixed object for stabilizing the device effective to allow a user to propel themselves upwards by pulling on the frame assembly when ascending up an incline.

Aspect 38: The device of any preceding aspect, wherein the extendable portion of the leg comprises a foot having a connecting means or attachment component configured to releasably attach to a fixed object.

Aspect 39: The device of any preceding aspect, wherein the fixed object and the attachment component cooperate to releasably secure the frame assembly to the fixed object for stabilizing the device effective to allow a user to propel themselves upwards by pulling on the frame assembly when ascending up an incline.

Aspect 40: The device of any preceding aspect, wherein the fixed object comprises a stabilizing component or other means for securely stabilizing the frame assembly and/or legs in fixed position.

Aspect 41: The device of any preceding aspect, wherein the fixed object comprises a groove, and the attachment component comprises a tongue, and where the tongue and groove cooperate to releasably secure the frame assembly to the fixed object.

Aspect 42: The device of any preceding aspect, wherein the fixed object and/or stabilizing component comprises a rail or channel or other structural means for releasably coupling with the attachment component.

Aspect 43: The device of any preceding aspect, wherein the leg comprises a guiding mechanism configured to direct movement of the extendable portion along a fixed travel path.

Aspect 44: The device of any preceding aspect, wherein the guiding mechanism is configured to prevent rotational movement of the extendable portion.

Aspect 45: The device of any preceding aspect, wherein the guiding mechanism comprises a slot and pin arrangement, or like mechanism effective to control the travel path and/or rotation of the extendable portion of the leg.

Aspect 46: The device of any preceding aspect, wherein the slot is disposed along the upper leg portion and the pin is disposed on an outer surface at the first end of the extendable portion, the slot being configured to receive and direct movement of the pin along the slot in a fixed travel path.

Aspect 47: The device of any preceding aspect, wherein the braking mechanism is in mechanical communication with each leg configured to selectively secure or lock the extendable portion of the leg at a fixed leg length.

Aspect 48: The device of any preceding aspect, wherein the braking mechanism comprises a locked position and an unlocked position.

Aspect 49: The device of any preceding aspect, wherein in the locked position, the extendable portion of the leg is in a locked state at a fixed leg length.

Aspect 50: The device of any preceding aspect, wherein in the unlocked position, the extendable portion of the leg is in an unlocked state whereby the leg length can be adjusted.

Aspect 51: The device of any preceding aspect, wherein releasing the braking mechanism, or moving into unlocked position, is configured to allow the user to adjust the leg length of each leg by applying pressure to a portion of the side frame to shorten a corresponding leg and thereby cooperatively lengthen the other leg of the side frame.

Aspect 52: The device of any preceding aspect, wherein the braking mechanism is attached to an outer surface at the second end of the upper leg portion or member.

Aspect 53: The device of any preceding aspect, wherein the braking mechanism comprises first and second portions, the first portion being attached to an outer surface at the second end of the upper leg portion and the second portion in mechanical communication for selectively securing or locking the extendable portion of the leg.

Aspect 54: The device of any preceding aspect, wherein the braking mechanism comprises a plurality of gripping members for releasably securing or locking the extendable portion of the leg.

Aspect 55: The device of any preceding aspect, wherein the plurality of gripping members is configured to be grippingly secured against an outer surface of the extendable portion of the leg in the locked state.

Aspect 56: The device of any preceding aspect, wherein the plurality of gripping members is configured to flex outward from the extendable portion of the leg in the unlocked state to thereby allow travel and adjustment of the leg length.

Aspect 57: The device of any preceding aspect, wherein the plurality of gripping members is releasably secured against an outer surface of the extendable portion of the leg in the locked state using a compression element or other means for forcibly securing the gripping members against the outer surface of the extendable portion effective to maintain the extendable portion in a locked state.

Aspect 58: The device of any preceding aspect, wherein the compression element comprises a ring disposed around an outer surface of the gripping members.

Aspect 59: The device of any preceding aspect, wherein the compression element comprises a locked position and an unlocked position.

Aspect 60: The device of any preceding aspect, wherein the compression element locked position corresponds to a position on the plurality of gripping members effective to forcibly securing the gripping members against the outer surface of the extendable portion.

Aspect 61: The device of any preceding aspect, wherein the compression element unlocked position corresponds to a position on the gripping members effective to allow the gripping members to flex outward from the extendable portion to allow travel and adjustment of the extendable portion of the leg.

Aspect 62: The device of any preceding aspect, further comprising a spring or tension element or other means for producing a force effective to releasably maintain the compression element in a locked position.

Aspect 63: The device of any preceding aspect, wherein the actuator is configured to move or pull the compression element from a locked position to an unlocked position.

Aspect 64: The device of any preceding aspect, wherein the braking mechanism comprises a plurality of locking members for releasably locking the extendable portion of the leg at a fixed position in a locked state.

Aspect 65: The device of any preceding aspect, wherein the plurality of locking members is configured to be releasably inserted into one or more apertures disposed on a surface of the extendable portion of the leg to lock the position of extendable portion in the locked state.

Aspect 66: The device of any preceding aspect, wherein the plurality of locking members is configured to be retracted out from the apertures of the extendable portion of the leg into the unlocked state to thereby allow travel of the extendable portion and adjustment of the leg length.

Aspect 67: The device of any preceding aspect, wherein the plurality of locking members is releasably secured in the apertures of the extendable portion of the leg in the locked state using a compression element or other means for forcibly driving the locking plunge members towards the apertures of the extendable portion effective to maintain the extendable portion in a locked state.

Aspect 68: The device of any preceding aspect, wherein the compression element comprises a locked position and an unlocked position.

Aspect 69: The device of any preceding aspect, wherein the compression element comprises a plunger body disposed on an outer surface of the braking mechanism body and in operable and/or mechanical communication with the locking member to drive the locking member towards the apertures of the extendable portion of the leg.

Aspect 70: The device of any preceding aspect, the plunger body is hingedly attached to the braking mechanism body.

Aspect 71: The device of any preceding aspect, wherein the locked position corresponds to a position where the plunger body of the spring plunger is on or sufficiently near the braking mechanism body effective to cause at least a portion of the locking members to be inserted into an aperture of the extendable portion effective to lock the extendable portion of the leg at a fixed position corresponding to a leg length.

Aspect 72: The device of any preceding aspect, wherein the unlocked position corresponds to a position where the plunger body of the spring plunger is sufficiently retracted or rotated away from the braking mechanism body effective to retract the one or more locking members from within the apertures of the extendable portion to allow travel of the extendable portion and adjustment of the leg length.

Aspect 73: The device of any preceding aspect, wherein the plunger body comprise a spring or tension element or other means for producing a force effective to maintain the plunger and/or locking members in a locked position.

Aspect 74: The device of any preceding aspect, wherein the actuator is configured to move or pull the plunger body from a locked position to an unlocked position.

Aspect 75: The device of any preceding aspect, wherein each actuator is operable communication with the braking mechanism of both the first and second legs.

Aspect 76: The device of any preceding aspect, wherein the actuator is configured to move the braking mechanism from a locked position to an unlocked position and/or vice versa.

Aspect 77: The device of any preceding aspect, wherein each side frame comprises an actuator.

Aspect 78: The device of any preceding aspect, wherein each actuator is configured to simultaneously control operation of the braking mechanism of both the first and second legs.

Aspect 79: The device of any preceding aspect, wherein each actuator is configured to simultaneously unlock or release the braking mechanism of both the first and second legs.

Aspect 80: The device of any preceding aspect, wherein the frame assembly comprises first and second actuators in operable communication with the at least one braking mechanism configured to selectively release the extendable portion of each leg, such as from a locked state to an unlocked state, to allow adjustment of the leg length.

Aspect 81: The device of any preceding aspect, wherein the device is configured to allow the leg length to be selectively adjusted by a user with the first and second actuators while grasping the gripping members during use.

Aspect 82: The device of any preceding aspect, wherein the actuator comprises a lever, switch, handle, knob, trigger, and/or other means for controlling operation of the braking mechanism.

Aspect 83: The device of any preceding aspect, wherein the leg adjustment system including a one or more spring or tension elements, such as, for example, compression springs, that extend through a portion of each leg and configured to exert a predetermined and/or constant amount of force against the extendable portion of the leg, and a cable connecting the extendable portion of the first leg with the extendable portion of the second leg, the cable having a predetermined length and configured to limit travel of one or both of the extendable portions.

Aspect 84: The device of any preceding aspect, wherein the leg adjustment system extends from an upper portion of a first leg through the gripping member into the upper portion of the second leg.

Aspect 85: The device of any preceding aspect, wherein the leg adjustment system comprise an internal sheath or housing configured to contain the connector cable.

Aspect 86: The device of any preceding aspect, wherein the leg adjustment system is configured to maintain a leg length adjustment ratio between the first and second legs of about 1:1.

Aspect 87: The device of any preceding aspect, wherein the tension element is configured to force the extendable portion of the leg to extend downward (i.e., lengthen) from within the fixed leg portion.

Aspect 88: The device of any preceding aspect, wherein the one or more tension elements extend through a portion of each leg.

Aspect 89: The device of any preceding aspect, wherein the leg adjustment system is configured to maintain a 1:1 leg length adjustment ratio between the first and second legs.

Aspect 90: The device of any preceding aspect, wherein the leg adjustment system is configured to maintain a 1:1 travel ratio between the extendable portions of the first and second legs.

Aspect 91: The device of any preceding aspect, wherein the leg adjustment system is configured to lengthen one leg at a 1:1 ratio in response to the user shortening the other leg of the side frame.

Aspect 92: The device of any preceding aspect, wherein the tension elements and cable cooperate to maintain a 1:1 length adjustment ratio between the first and second legs.

Aspect 93: The device of any preceding aspect, wherein the tension elements and cable cooperate to maintain a 1:1 travel ratio between the extendable portion of the first and second legs.

Aspect 94: The device of any preceding aspect, wherein the leg adjustment system comprises at least one retention element attached within an upper portion of each of the first and second legs.

Aspect 95: The device of any preceding aspect, wherein the retention element comprise at least one aperture configured to allow passage of a cable and/or connection of the cable.

Aspect 96: The device of any preceding aspect, wherein a retention element comprises an aperture and wherein the cable is secured within the aperture or at a point immediately after passing through the aperture.

Aspect 97: The device of any preceding aspect, wherein the retention element comprises an attachment point for connecting an end of a compression spring or the like.

Aspect 98: The device of any preceding aspect, wherein the leg adjustment system comprises at least one retention element attached to the first ends of the extendable portions of each of the first and second legs.

Aspect 99: The device of any preceding aspect, wherein the leg adjustment system comprises at least one retention element attached within the first ends of the extendable portions of each of the first and second legs.

Aspect 100: The device of any preceding aspect, wherein the leg adjustment system comprises at least one retention element attached within an upper portion of each of the first and second legs, and at least one retention element attached to the first ends of the extendable portions of each of the first and second legs.

Aspect 101: The device of any preceding aspect, wherein the leg adjustment system comprises a first retention element attached within an upper portion of each of the first and second legs, and a second retention element attached to the first ends of the extendable portions of each of the first and second legs.

Aspect 102: The device of any preceding aspect, wherein the retention element and the first end of the extendable portion of the leg define a space within the leg for containing the tension element.

Aspect 103: The device of any preceding aspect, wherein a first end of the tension element is connected to a first retention element and a second end of the tension element is connected to a second retention element.

Aspect 104: The device of any preceding aspect, wherein a first retention element is fixed and a second retention element is configured to move with the extendable portion of the leg.

Aspect 105: The device of any preceding aspect, wherein a first retention element comprises an aperture to allow passage of the cable and a second retention element comprises an attachment point for securing the cable of the leg adjustment system.

Aspect 106: The device of any preceding aspect, wherein the left front leg and the left rear leg are connected to one another using one cable; and the right front leg and the right rear leg are connected to one another using another cable.

Aspect 107: The device of any preceding aspect, wherein the cable comprises a tendon, filament, line, flexible rod, line or other tensile element.

Aspect 108: An assistive mobility kit comprising: a) the assistive mobility device of any preceding aspect; and b) instructions for using the assistive mobility device in connection with a method for ambulating and/or traversing stairs.

Aspect 109: The kit of any preceding aspect, where the method comprises any method disclosed herein.

Aspect 110: The kit of any preceding aspect, wherein the method comprises affixing the stabilizing component of any preceding aspect to a portion of a stair.

Aspect 111: The kit of any preceding aspect, wherein the method comprises releasably attaching the assistive mobility device to the stabilizing component in connection with traversing stairs.

While aspects of the present invention can be described and claimed in a particular statutory class, such as the system statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way appreciably intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Throughout this application, various publications are referenced. The disclosures of these publications in their entireties are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present invention is not entitled to antedate such publication by virtue of prior invention. Further, the dates of publication provided herein can be different from the actual publication dates, which can require independent confirmation.

The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An assistive mobility device comprising:

a) a frame assembly comprising:

i) a first side frame connected with a second side frame, each side frame comprising:

a first leg and second leg, each having first and second opposed ends, and a gripping member connecting first ends of the first and second legs, the second end of the first leg having an extendable portion configured to allow selective adjustment of a leg length;

a leg adjustment system contained within a portion of each side frame configured to lengthen one leg to a predefined leg length; and a braking mechanism in mechanical communication with the extendable portion of the first leg configured to releasably secure the extendable portion of the first leg at a fixed leg length;

ii) an actuator for each side frame in operable communication with the corresponding braking mechanism configured to selectively release the extendable portion of the first leg from a locked state to allow adjustment of the leg length; and iii) at least one cross support having first and second ends connecting the first side frame with the second side frame;

wherein the frame assembly is configured to releasably attach to a fixed object for stabilizing the frame assembly effective to allow a user to propel themselves upwards by pulling on the frame assembly when ascending up an incline;

wherein the frame assembly is collapsible, the first side frame being rotatably connected to a first end of the cross support of the frame assembly, the second side frame being rotatably connected to a second end of the cross support of the frame assembly;

wherein each braking mechanism comprises one or more locking members for releasably securing the extendable portion of the leg at a fixed position in a locked state, each of the locking members configured to be releasably inserted into one or more apertures disposed on a surface of the extendable portion of the leg in the locked state using a compression element for forcibly plunging the locking members into the apertures of the extendable portion effective to maintain the extendable portion at a fixed position, the compression element in mechanical communication with said one or more locking members to forcibly drive the locking member; and wherein the compression element comprises one or more plungers disposed on an outer surface of a braking mechanism body and in mechanical communication with the one or more locking members to forcibly drive the locking member towards the apertures of the extendable portion of the leg.

2. The device of claim 1, wherein each leg having an extendable portion comprises a guiding mechanism configured to direct movement of the extendable portion along a fixed travel path, the guiding mechanism comprising a slot and pin arrangement effective to control the travel path and rotation of the extendable portion of the leg.

3. The device of claim 1, wherein the second end of each second leg has an extendable portion configured to allow selective adjustment of leg length; wherein each second leg further comprises a braking mechanism in mechanical communication with the extendable portion of the second leg and configured to selectively secure the extendable portion of the second leg at a fixed leg length.

4. The device of claim 3, wherein the actuator of each side frame is in operable communication with the braking mechanism of the first leg and the braking mechanism of the second leg and configured to selectively operate the braking mechanisms to release the extendable portion of both the first leg and second leg from a locked state to allow adjustment of the leg length.

5. The device of claim 1, wherein the one or more locking members are configured to be retracted out from the apertures of the extendable portion of the leg into the unlocked state to thereby allow travel of the extendable portion and adjustment of the leg length.

6. The device of claim 1, wherein the actuator of each side frame is configured to control operation of the corresponding braking mechanism of the first leg.

7. The device of claim 1, wherein the leg adjustment system of each side frame comprises one or more spring elements that extend through a portion of the first leg and configured to exert a predetermined amount of force against the extendable portion of the first leg, and a cable configured to limit travel of the extendable portion.

8. The device of claim 1, wherein each leg adjustment system of each side frame is configured to correspondingly lengthen one leg of the side frame at a predefined leg length adjustment ratio in response to shortening of the other leg; and configured to maintain a 1:1 travel ratio between the extendable portions of the first and second legs.

9. The device of claim 1, wherein each leg comprises an attachment component for releasably attaching to the fixed object; and wherein the fixed object and the attachment component cooperate to releasably secure the frame assembly to the fixed object for stabilizing the device.

10. The device of claim 9, wherein the fixed object comprises a stabilizing component configured to releasably couple with the frame assembly to securely stabilize the frame assembly in a fixed position.

11. An assistive mobility system comprising:

an assistive mobility device configured to releasably attach to a stabilizing component, the assistive mobility device comprising:

a frame assembly comprising:

a first side frame connected with a second side frame, each side frame comprising:

a first leg and second leg, each having first and second opposed ends, and a gripping member connecting first ends of the first and second legs, the second end of the first leg having an extendable portion configured to allow selective adjustment of a leg length, the first and second legs having an attachment component configured to releasably attach to a stabilizing component;

a leg adjustment system contained within a portion of each side frame configured to lengthen or shorten one leg to a predefined leg length, the leg adjustment system comprising one or more spring elements that extend through a portion of the first leg and are configured to exert a predetermined amount of force against the extendable portion of the first leg; and a braking mechanism in mechanical communication with the extendable portion of the first leg configured to releasably secure the extendable portion of the first leg at a fixed leg length;

an actuator connected to each side frame in operable communication with the corresponding braking mechanism for selectively releasing the extendable portion of the first leg from a locked state to allow adjustment of the leg length; and at least one cross support having first and second ends connecting the first side frame with the second side frame; and at least one stabilizing component configured to releasably couple with the attachment component for stabilizing the assistive mobility device effective to allow a user to propel themselves upwards by pulling on the frame assembly when ascending up stairs.

12. The system of claim 11, wherein the second end of each second legs has an extendable portion configured to allow selective adjustment of leg length; where each second leg further comprises a braking mechanism in mechanical communication with the extendable portion of each second leg and configured to selectively secure the extendable portion of the second leg at a fixed leg length; and wherein releasing the braking mechanism of each second leg allows the user to adjust the leg length.

13. The system of claim 12, wherein each leg adjustment system of each side frame is configured to correspondingly lengthen one leg of the side frame at a predefined leg length adjustment ratio in response to shortening of the other leg of the side frame.

14. The system of claim 11, wherein each braking mechanism comprises a member for releasably securing the extendable portion of the leg at a fixed position in a locked state, each member configured to be releasably inserted into one or more apertures disposed on a surface of the extendable portion of the leg in the locked state using a compression element for forcibly plunging the member into an aperture the extendable portion effective to maintain the extendable portion at a fixed position.

15. The system of claim 11, wherein the at least one stabilizing component is configured to attach to a portion of stairs.

16. An assistive mobility device comprising:

a) a frame assembly comprising:

i) a first side frame connected with a second side frame, each side frame comprising:

a first leg and second leg, each having first and second opposed ends, and a gripping member connecting first ends of the first and second legs, the second ends of the first leg having an extendable portion configured to allow selective adjustment of a leg length;

a leg adjustment system contained within a portion of each side frame configured to lengthen one leg at a predefined leg length; and a braking mechanism in mechanical communication with the extendable portion of the first leg configured to releasably secure the extendable portion of the first leg at a fixed leg length;

ii) an actuator connected to each side frame in operable communication with the corresponding braking mechanism configured to selectively release the extendable portion of the first leg from a locked state to allow adjustment of the leg length; and iii) at least one cross support having first and second ends connecting the first side frame with the second side frame;

wherein the frame assembly is configured to releasably attach to a fixed object for stabilizing the frame assembly effective to allow a user to propel themselves upwards by pulling on the frame assembly when ascending up an incline;

wherein each leg comprises an attachment component for releasably attaching to the fixed object, wherein the fixed object and the attachment component cooperate to releasably secure the frame assembly to the fixed object for stabilizing the device;

wherein the frame assembly is collapsible, the first side frame being rotatably connected to a first end of the cross support of the frame assembly, the second side frame being rotatably connected to a second end of the cross support of the frame assembly; and wherein each braking mechanism comprises one or more members for releasably securing the extendable portion of the leg at a fixed position in a locked state.

17. The device of claim 16, wherein the fixed object comprises a stabilizing component configured to releasably couple with the attachment component of the frame assembly to securely stabilize the frame assembly in a fixed position.

18. The device of claim 17, wherein the stabilizing component comprises a rail or slotted structure.

19. The device of claim 16, wherein the second end of each second leg has an extendable portion configured to allow selective adjustment of leg length; wherein each second leg further comprises a braking mechanism in mechanical communication with the extendable portion of the second leg and configured to selectively secure the extendable portion of the second leg at a fixed leg length.

* * * * *